US011268767B2

(12) United States Patent
Dong et al.

(10) Patent No.: US 11,268,767 B2
(45) Date of Patent: Mar. 8, 2022

(54) HEAT EXCHANGER

(71) Applicant: HANGZHOU SANHUA RESEARCH INSTITUTE CO., LTD., Hangzhou (CN)

(72) Inventors: Junqi Dong, Hangzhou (CN); Weiwei Zhang, Hangzhou (CN); Jianhua Gao, Hangzhou (CN)

(73) Assignee: HANGZHOU SANHUA RESEARCH INSTITUTE CO., LTD., Hangzhou (CN)

( * ) Notice: Subject to any disclaimer, the term of this patent is extended or adjusted under 35 U.S.C. 154(b) by 29 days.

(21) Appl. No.: 16/964,181

(22) PCT Filed: May 17, 2019

(86) PCT No.: PCT/CN2019/087390

§ 371 (c)(1),
(2) Date: Jul. 22, 2020

(87) PCT Pub. No.: WO2019/219076

PCT Pub. Date: Nov. 21, 2019

(65) Prior Publication Data

US 2021/0033343 A1 Feb. 4, 2021

(30) Foreign Application Priority Data

May 17, 2018 (CN) ..... 201820733443.5
Jul. 27, 2018 (CN) ..... 201821207479.6

(51) Int. Cl.
*F28F 9/02* (2006.01)
*F28D 1/053* (2006.01)

(52) U.S. Cl.
CPC ..... *F28D 1/053* (2013.01); *F28F 9/02* (2013.01)

(58) Field of Classification Search
CPC ..... F28D 1/053; F28F 9/02
USPC ..... 165/175
See application file for complete search history.

(56) References Cited

U.S. PATENT DOCUMENTS 4,582,127 A * 4/1986 Moranne ..... F28F 9/18 165/83
5,816,316 A * 10/1998 Hoffnung ..... F28F 9/0224 165/76
5,881,456 A * 3/1999 Bergins ..... B21D 53/02 29/890.052

(Continued)

FOREIGN PATENT DOCUMENTS

CN 103959001 A 7/2014
CN 104121727 A 10/2014

(Continued)

*Primary Examiner* — Davis D Hwu
(74) *Attorney, Agent, or Firm* — Cheng-Ju Chiang

(57) ABSTRACT

A heat exchanger includes a first collecting pipe, a second collecting pipe and a number of flat tubes connected between the first collecting pipe and the second collecting pipe. The first collecting pipe includes a first upper main board and a first lower main board. A first channel and a second channel are formed between the first upper main board and the first lower main board. The second collecting pipe includes a third channel and a fourth channel. The third channel is communicated with the first channel through a row of the flat tubes. The fourth channel is communicated with the second channel through another row of the flat tubes.

20 Claims, 17 Drawing Sheets

(56) References Cited

U.S. PATENT DOCUMENTS

2019/0049186 A1* 2/2019 Yoshimura ..... F25B 39/00

FOREIGN PATENT DOCUMENTS

| | | | |
|---|---|---|---|
| CN | 104350352 | A | 2/2015 |
| CN | 105004213 | A | 10/2015 |
| CN | 208595829 | U | 3/2019 |
| CN | 208704493 | U | 4/2019 |
| DE | 102006046061 | A1 | 4/2007 |
| EP | 1813903 | A1 | 8/2007 |
| EP | 2402701 | A1 | 1/2012 |
| EP | 2705318 | A1 | 3/2014 |
| JP | 2005-90823 | A | 4/2005 |
| KR | 10-2007-0081334 | A | 8/2007 |
| WO | 2013/176391 | A1 | 11/2013 |

* cited by examiner

HEAT EXCHANGER

This application is a 35 U. S. C. § 371 National Phase conversion of International (PCT) Patent Application No. PCT/CN2019/087390, entitled "Heat Exchanger", filed on May 17, 2019, which requires priorities of a Chinese Patent Application filed on May 17, 2018 with Application No. 201820733443.5 and a Chinese Patent Application filed on Jul. 27, 2018 with Application No. 201821207479.6, the entire contents of which are incorporated into this application herein by reference. The PCT International Patent Application was filed and published in Chinese.

TECHNICAL FIELD

The present disclosure relates to a field of heat exchange technology, for example, a heat exchanger.

BACKGROUND

Taking $CO_2$ as a refrigerant fluid for example, working pressure of a double-row heat exchanger is high, thus the strength requirement of the heat exchanger collecting pipe is relatively high. Commonly used D-tubes cannot meet the bursting pressure requirements, so in order to meet their design requirements, the collecting pipe mostly adopts a method of increasing the wall thickness of the D-tubes. However, this will cause a size of the collecting pipe to be too large which renders the weight of the heat exchanger to be too heavy, and reduce the windward area under the same external dimensions.

SUMMARY

The present disclosure provides a heat exchanger to solve the problems that when the heat exchanger uses a refrigerant fluid with high working pressure in the related art, the size of the collecting pipe is too large and the windward area is reduced under the same external dimensions.

In one embodiment, the present disclosure provides a heat exchanger including a first collecting pipe which includes a first upper main board and a first lower main board. A first channel and a second channel are formed between the first upper main board and the first lower main board. Flat tubes extend into the first channel and the second channel.

1: first collecting pipe; 11: first upper main board; 12: first lower main board; 13: first intermediate main board; 14: first channel; 15: second channel; 16: first partition; 17: second intermediate main board; 111: groove; 112: second middle rib; 113: first reinforcing rib; 114: partition slot; 115: third middle rib; 116: second partition; 118: first through hole or second through slot; 119: second through hole or third through slot; 121: first middle rib; 123: first flat tube slot; 124: second flat tube slot; 125: side wall; 131: first slot; 132: first through slot; 171: second slot; 172: third slot;

2: second collecting pipe; 21: second lower main board; 22: third intermediate main board; 23: second upper main board; 24: third channel; 25: fourth channel; 26: fourth partition; 211: fourth middle rib; 212: flow equalizing plate; 213: second reinforcing rib; 214: third partition; 221: fourth slot; 222: fifth slot;

3: flat tube; 4: inlet; 5: outlet; 6: side plate; 7: end cap; 8: blocking cap; 91: first chamber; 92: second chamber; 101: third chamber; 102: fourth chamber.

DETAILED DESCRIPTION

First Embodiment

Figure 1:
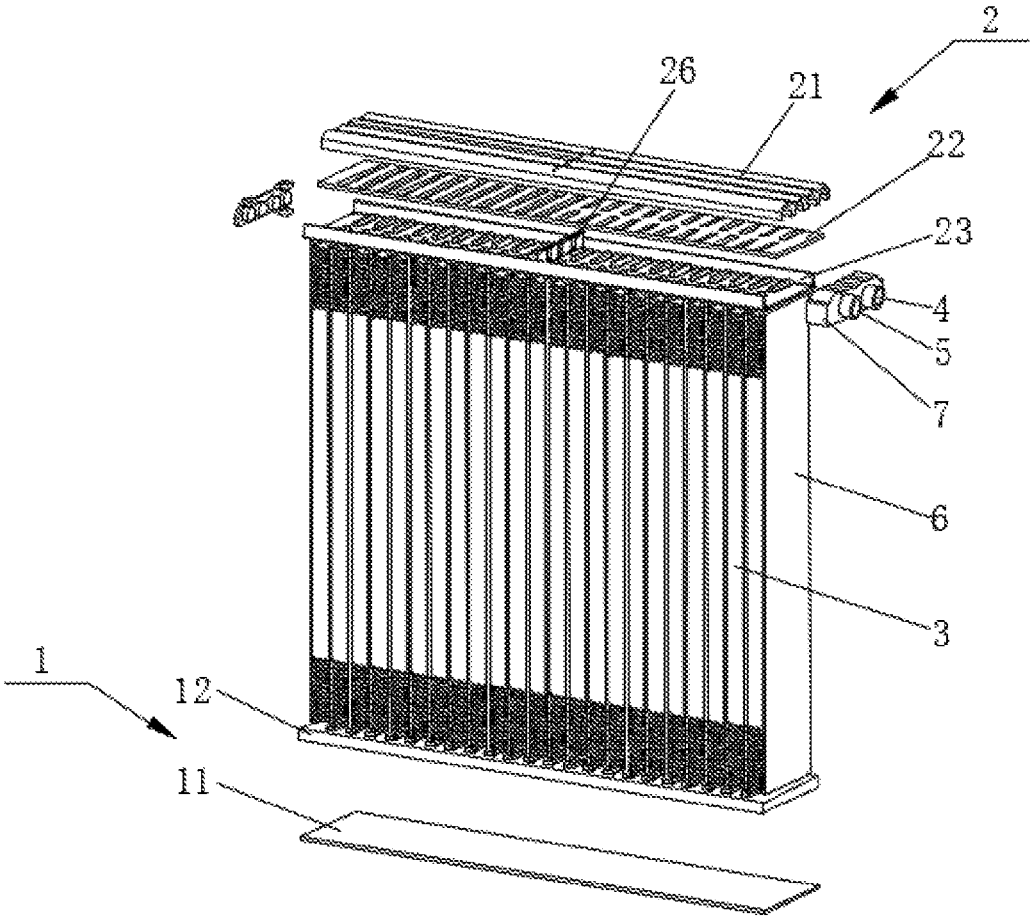
FIG. 1 is a schematic structural view of a heat exchanger in a first embodiment of the present disclosure.
Figure 2:
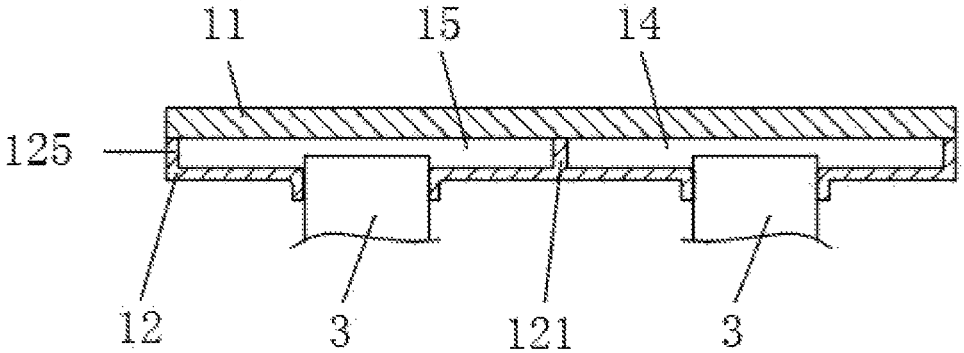
FIG. 2 is a cross-sectional view of a first collecting pipe installed with flat tubes in the first embodiment of the present disclosure.

This embodiment provides a heat exchanger. As shown in FIGS. 1 and 2, the heat exchanger includes a first collecting pipe 1, two rows of flat tubes 3 and a second collecting pipe 2, fins connected to the flat tubes 3 (not labelled), side plates 6 provided outside of the outermost flat tubes 3, and an end cap 7 provided at one end of the second collecting pipe 2. The first collecting pipe 1, the two rows of flat tubes 3 and the second collecting pipe 2 are arranged in order from a bottom-to-top direction. The end cap 7 is provided with an inlet 4 and an outlet 5, in which the inlet 4 is configured to flow into a refrigerant fluid in a gas-liquid two-phase mixed state, and the outlet 5 is configured to flow out of refrigerant gas.

As shown in FIG. 2, the first collecting pipe 1 includes a first upper main board (or a first outer main board) 11 and a first lower main board (or a first inner main board) 12 that are hermetically connected. The first upper main board 11 has a flat top surface. The first lower main board 12 has a side wall 125 which is bent toward the first upper main board 11 and supported on the first upper main board 11. The middle of the first lower main board 12 is provided with a first middle rib 121 supported on the first upper main board 11. A first channel 14 and a second channel 15 are formed by a top wall, the side wall 125 and the first middle rib 121 of the first lower main board 12 and the first upper main board 11 through welding. The flat tubes 3 are provided in two rows, wherein one ends of a first row of flat tubes 3 are placed in the first channel 14, and one ends of a second row of flat tubes 3 which are located at the same side of the first row of flat tubes 3 are placed in the second channel 15.

In this embodiment, a vertical height between the highest point and the lowest point of the first channel 14 and the second channel 15 is L1, and a maximum value of the width of the first channel 14 and the second channel 15 is L2. The ratio of L1 to L2 is not greater than 1:4. Through the setting of the above ratio and the structure of the first upper main board 11 with a flat top surface, the size of the first collecting pipe 1 can be made more compact, and thus the heat exchanger has a larger windward area and higher heat exchange performance. Moreover, the heat exchanger has a higher structural strength and can meet high strength requirements when using a refrigerant fluid with high working pressure.

In this embodiment, a plurality of first flat tube slots 123 are provided on the first lower main board 12, and the wall of the first flat tube slots 123 protrudes toward the second collecting pipe 2. The two rows of flat tubes 3 are inserted into the first flat tube slots 123 so as to be placed in the first channel 14 and the second channel 15. The above-mentioned first flat tube slots 123 adopt a structure of outward burring (specifically burring away from the first upper main board 11), which can increase the contact area with the flat tubes 3, thereby increasing the connection strength of the first flat tube slots 123 and the flat tubes 3. In this embodiment, the first flat tube slots 123 and the flat tubes 3 are connected by brazing. In this embodiment, the length of the first flat tube slot 123 is greater than of the shrinkage width of the flat tubes 3 by 0.05 mm to 0.1 mm. The width of the first flat tube slot 123 is greater than the thickness of the flat tubes 3 by 0.05 mm to 0.12 mm. The height of the burring of the first flat tube slot 123 is 0.7-1.3 times of the thickness of the flat tubes 3.

Figure 3:
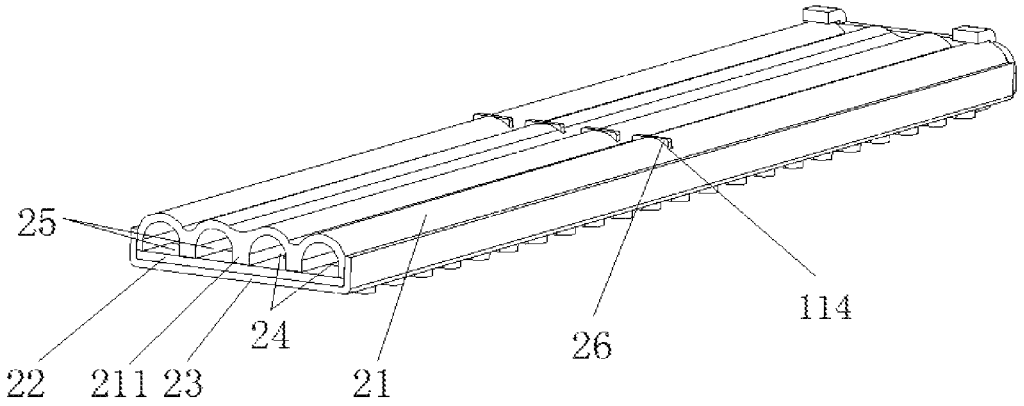
FIG. 3 is a schematic structural view of a second collecting pipe in the first embodiment of the present disclosure.

Referring to FIG. 3, the second collecting pipe 2 of this embodiment includes a second lower main board (or a second outer main board) 21, a second intermediate main board 22 and a second upper main board (or a second inner main board) 23 which are arranged in turn along the bottom-to-top direction. In one embodiment, the second upper main board 23 is wrapped around the second lower main board 21 and the third intermediate main board 22, and are fixed together by welding to form the second collecting pipe 2. Furthermore, in this embodiment, the second lower main board 21 includes a fourth middle rib 211 and a plurality of fourth partitions 26, and the fourth middle rib 211 is supported on the third intermediate main board 22. The fourth middle rib 211 divides the second lower main board 21 into two parts, and these two parts form a third channel 24 and a fourth channel 25 together with the third intermediate main board 22 and the second upper main board 23 (shown in FIG. 3). In the two rows of flat tubes 3, the other ends of the first row of flat tubes 3 extend into the third channel 24, and the other ends of the second row of flat tubes 3 extend into the fourth channel 25.

In each channel of the second lower main board 21, a group of partition slots 114 are formed along a width direction. Each partition slot 114 is inserted by the corresponding one of the fourth partitions 26. By the arrangement of the fourth partitions 26, the third channel 24 and the fourth channel 25 can be divided into two parts, which can realize the multi-process operation of the refrigerant.

Figure 4:
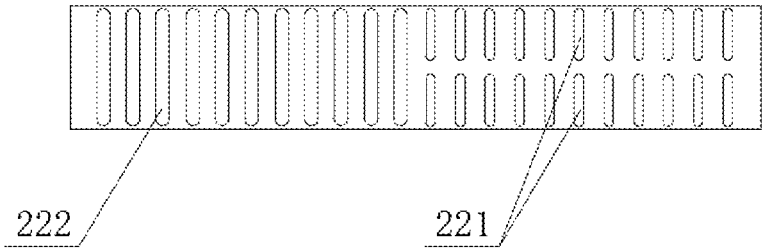
FIG. 4 is a schematic structural view of a second intermediate main board of the second collecting pipe in the first embodiment of the present disclosure.

As shown in FIG. 4, two rows of fourth slots 221 and one row of fifth slots 222 are formed in the third intermediate main board 22. Both rows of fourth slots 221 are located on one side of the fourth partitions 26 (referred to as a first side in this embodiment). Upper ends of a part of the flat tubes 3 in the two rows are respectively placed in the two rows of fourth slots 221. The length of each fifth slot 222 is greater than that of the fourth slot 221, and the above-mentioned row of fifth slots 222 is located on the other side of the fourth partitions 26 (referred to as a second side in this embodiment). The fifth slots 222 are provided to connect partial channel of the third channel 24 and the fourth channel 25 which are located at the second side of the fourth partitions 26. In one embodiment, a gap between the fourth slot 221 and an outer periphery of the flat tubes 3 is relatively large. The length of the fourth slot 221 is greater than the width of the flat tube 3 by 0.4 mm to 3 mm, and the width is greater than the thickness of the flat tubes 3 by 0.4 mm to 3 mm.

The second collecting pipe 2 of this embodiment is composed of three main boards, which can further meet the high strength requirements of the heat exchanger when using a refrigerant fluid with high working pressure.

The operating principle of the above heat exchanger in this embodiment is as follows:

Firstly, the refrigerant fluid flows through the inlet 4 into a partial channel of the third channel 24 which is located on the first side of the fourth partitions 26 of the second collecting pipe 2. At this time, the refrigerant fluid enters a first process. In the first process, the refrigerant fluid enters the rear flat tubes 3 and flows downwardly along the rear flat tubes 3. During this time, the air and the refrigerant fluid exchange heat, the refrigerant fluid evaporates and absorbs heat, and part of the liquid evaporates into steam, and the dryness increases. Then, the refrigerant fluid enters the first channel 14 of the first collecting pipe 1 along the rear flat tubes 3 and thus enters a second process. In the second process, the refrigerant fluid enters part of the third channel 24 located on the second side of the fourth partitions 26 through the rear flat tubes 3, and further evaporates and absorbs heat during this process. Subsequently, the refrigerant fluid enters part of the channel on the second side of the fourth partitions 26 of the fourth channel 25 of the second collecting pipe 2 and thus enters a third process. In the third process, the refrigerant fluid enters the front flat tubes 3, further evaporates and absorbs heat, and then enters the second channel 15 of the first collecting pipe 1 and thus enters a fourth process. In the fourth process, the refrigerant fluid flows through the front row of flat tubes 3 to part of the fourth channel 25 on the first side of the fourth partitions 26, and further exchanges heat with the air during the flow process, evaporates into steam, and then the steam flows out through the outlet 5 to complete a heat exchange process.

Second Embodiment

This embodiment provides a heat exchanger. The difference between the heat exchanger and the heat exchanger described in the first embodiment is that the structure of the first collecting pipe 1 in this embodiment is different. The rest of the structure is the same as the first embodiment which will not be repeated here. Only the structure of the first collecting pipe 1 of this embodiment will be described in detail below.

Figure 5:
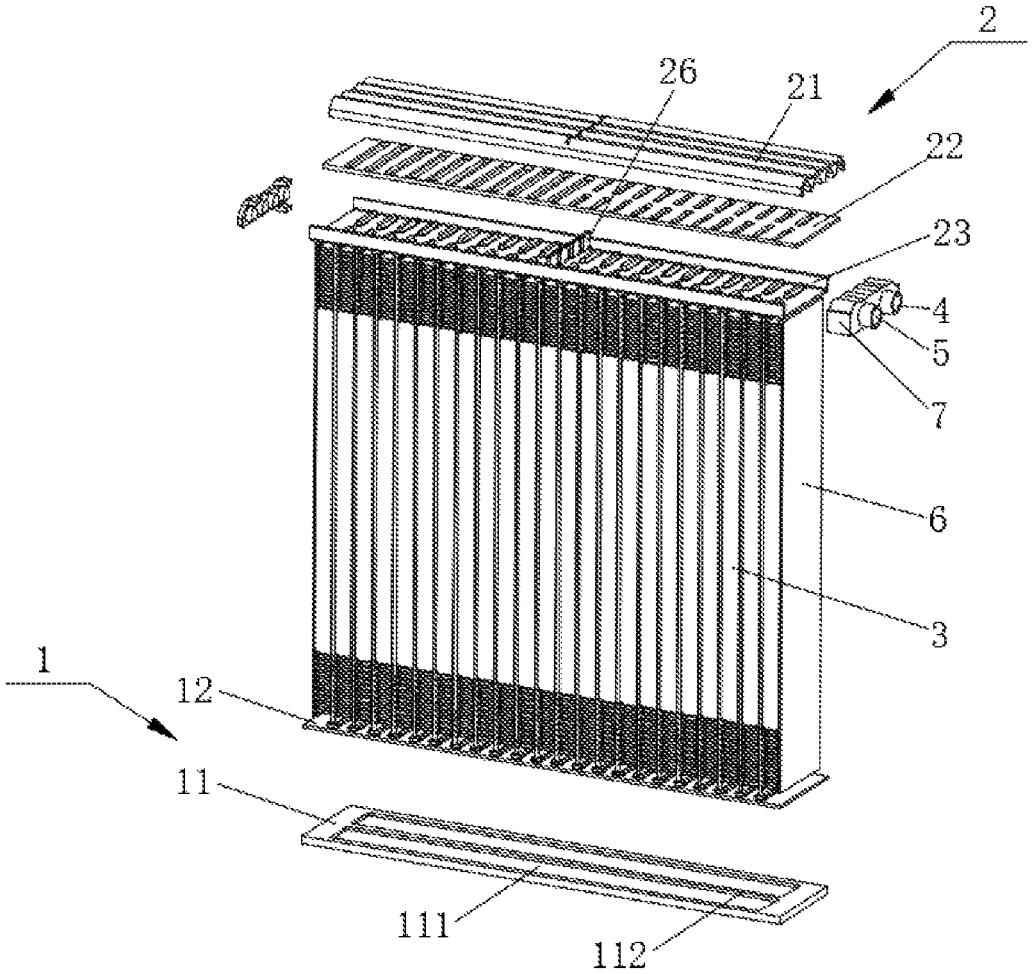
FIG. 5 is a schematic structural view of a heat exchanger in a second embodiment of the present disclosure.
Figure 6:
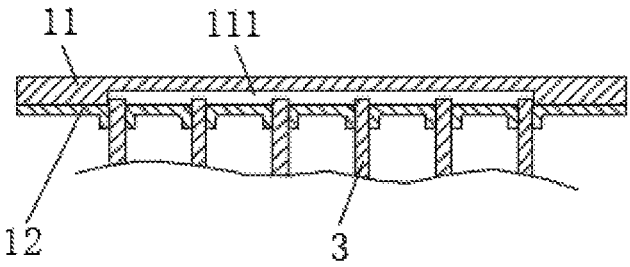
FIG. 6 is a cross-sectional view of a first collecting pipe installed with flat tubes in the second embodiment of the present disclosure.

Referring to FIGS. 5 and 6, the first collecting pipe 1 of this embodiment includes a first upper main board 11 and a first lower main board 12 welded together. The first upper main board 11 and the first lower main board 12 both have flat structures, in which a top surface of the first upper main board 11 is flat and a bottom surface of the first lower main board 12 is also flat. By making both the first upper main board 11 and the first lower main board 12 with flat plate structures, the structure of the first collecting pipe 1 of this embodiment is more compact.

Two grooves 111 are defined in the first upper main board 11. A second middle rib 112 is provided between the two grooves 111. A first channel 14 and a second channel 15 are formed by the two grooves 111, the second middle rib 112 and the first lower main board 12. One ends of a first row of flat tubes 3 are placed in the first channel 14, and the same ends of a second row of flat tubes 3 are placed in the second channel 15.

In one embodiment, a vertical height respectively between the highest point of the first channel 14 and the second channel 15 and the lowest point of the first channel 14 and the second channel 15 is L1, and a maximum value of the width of the first channel 14 and the second channel 15 is L2. The ratio of L1 to L2 is not greater than 1:4. Through the setting of the above ratio and the structure of the first upper main board 11 with a flat top surface, while working with a refrigerant fluid of high working pressure, the size of the first collecting pipe 1 can be made more compact, and thus the heat exchanger has a larger windward area and higher heat exchange performance. Moreover, the heat exchanger has a higher structural strength and can meet high strength requirements when using a refrigerant fluid with high working pressure.

In this embodiment, a plurality of first flat tube slots 123 are provided on the first lower main board 12, and the wall of the first flat tube slots 123 protrudes toward the second collecting pipe 2. The two rows of flat tubes 3 are inserted into the first flat tube slots 123 so as to be placed in the first channel 14 and the second channel 15. The above-mentioned first flat tube slots 123 adopt a structure of outward burring (specifically burring away from the first upper main board 11), which can increase the contact area with the flat tubes 3, thereby increasing the connection strength of the first flat tube slots 123 and the flat tubes 3. In this embodiment, the first flat tube slots 123 and the flat tubes 3 are connected by brazing. In this embodiment, the length of the first flat tube slots 123 is greater than of the shrinkage width of the flat tubes 3 by 0.05 mm to 0.1 mm. The width of the first flat tube slots 123 is greater than the thickness of the flat tubes 3 by 0.05 mm to 0.12 mm. The height of the burring of the tube slots 123 is 0.7-1.3 times of the thickness of the flat tubes 3.

The working principle of the heat exchanger of this embodiment is the same as that of the first embodiment, which will not be repeated here.

Third Embodiment

This embodiment provides a heat exchanger. The difference between the heat exchanger and the heat exchanger described in the second embodiment is that the structure of the first collecting pipe 1 in this embodiment is different. The rest of the structure is the same as the second embodiment which will not be repeated here. Only the structure of the first collecting pipe 1 of this embodiment will be described in detail below.

Figure 7:
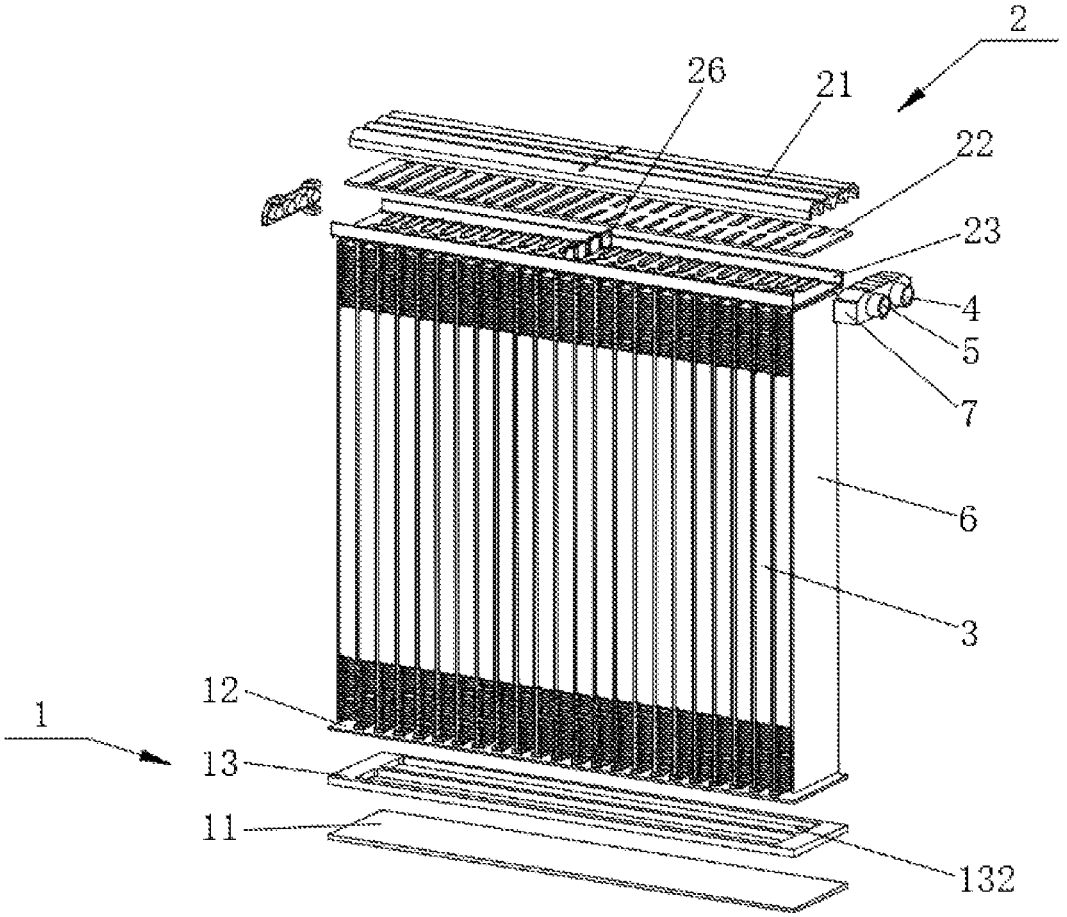
FIG. 7 is a schematic structural view of a heat exchanger in a third embodiment of the present disclosure.
Figure 8:
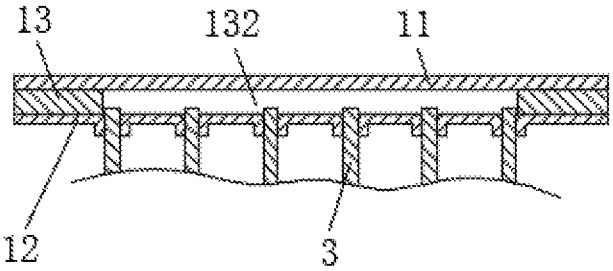
FIG. 8 is a cross-sectional view of a first collecting pipe installed with flat tubes in the third embodiment of the present disclosure.

As shown in FIGS. 7 and 8, in this embodiment, the first collecting pipe 1 includes a first upper main board 11, a first intermediate main board 13 and a first lower main board 12 that are sequentially arranged along a bottom-to-top direction and attached to each other by welding. The first upper main board 11 and the first lower main board 12 both have flat structures, in which a top surface of the first upper main board 11 is flat and a bottom surface of the first lower main board 12 is also flat. The first intermediate main board 13 defines two first through slots 132 arranged side by side. A first channel 14 and a second channel 15 are formed by the first upper main board 11, the first through slots 132 and the first lower main board 12. With the above structures, the strength of the overall structure of the first collecting pipe 1 can be increased, and the structure of the first collecting pipe 1 can be made more compact.

Fourth Embodiment

This embodiment provides a heat exchanger. The difference between the heat exchanger and the heat exchanger described in the third embodiment is that the structure of the first collecting pipe 1 in this embodiment is different. The rest of the structure is the same as the first embodiment which will not be repeated here. Only the structure of the first collecting pipe 1 of this embodiment will be described in detail below.

Figure 9:
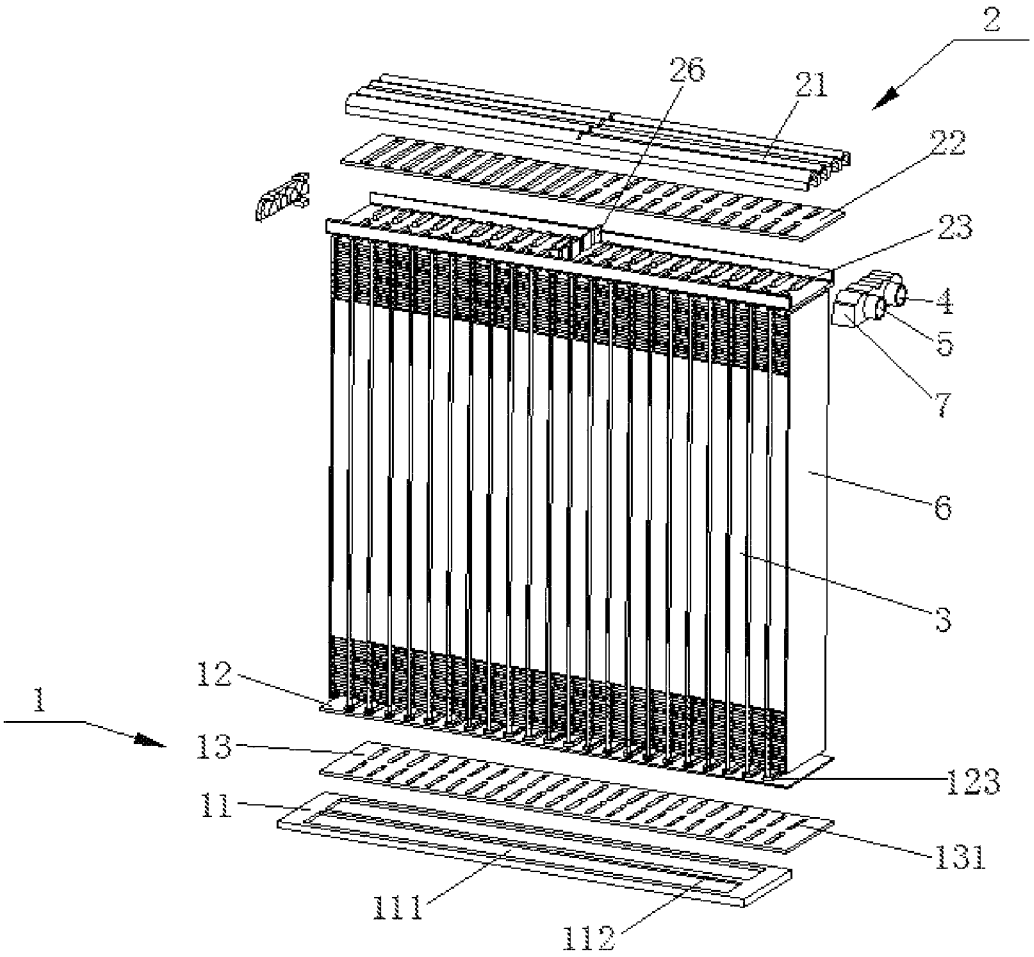
FIG. 9 is a schematic structural view of a heat exchanger in a fourth embodiment of the present disclosure.
Figure 10:
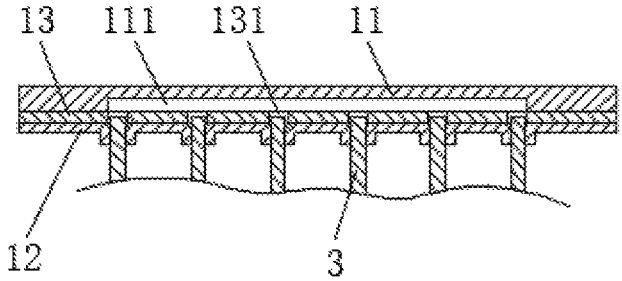
FIG. 10 is a cross-sectional view of a first collecting pipe installed with flat tubes in the fourth embodiment of the present disclosure.

As shown in FIGS. 9 and 10, in this embodiment, the first collecting pipe 1 includes a first upper main board 11, a first intermediate main board 13 and a first lower main board 12 that are sequentially arranged along a bottom-to-top direction and attached to each other by welding. The first lower main board 12 has a flat structure, that is, a bottom surface of the first lower main board 12 is a flat surface.

The structure of the above-mentioned first upper main board 11 is the same as the structure of the first upper main board 11 in the second embodiment, which will not be repeated here.

In this embodiment, two rows of first slots 131 are formed on the first intermediate main board 13. A first channel 14 and a second channel 15 are formed by the grooves 111 of the first upper main board 11, the first slots 131 and the first lower main board 12. With the above structure, not only the strength of the overall structure of the first collecting pipe 1 is increased, but also the structure of the first collecting pipe 1 is made more compact. Each of the first flat tube slots 123 of the first lower main board 12 corresponds to one of the first slots 131. One ends of the flat tubes 3 are sealed through the first flat tube slots 123 and placed in the first slots 131.

Fifth Embodiment

This embodiment provides a heat exchanger, which differs from the fourth embodiment in that the structure of the first collecting pipe 1 in this embodiment is different, and mounting positions of an end cap 8 and the inlet 4 and the outlet 5 thereon are different in this embodiment.

Figure 11:
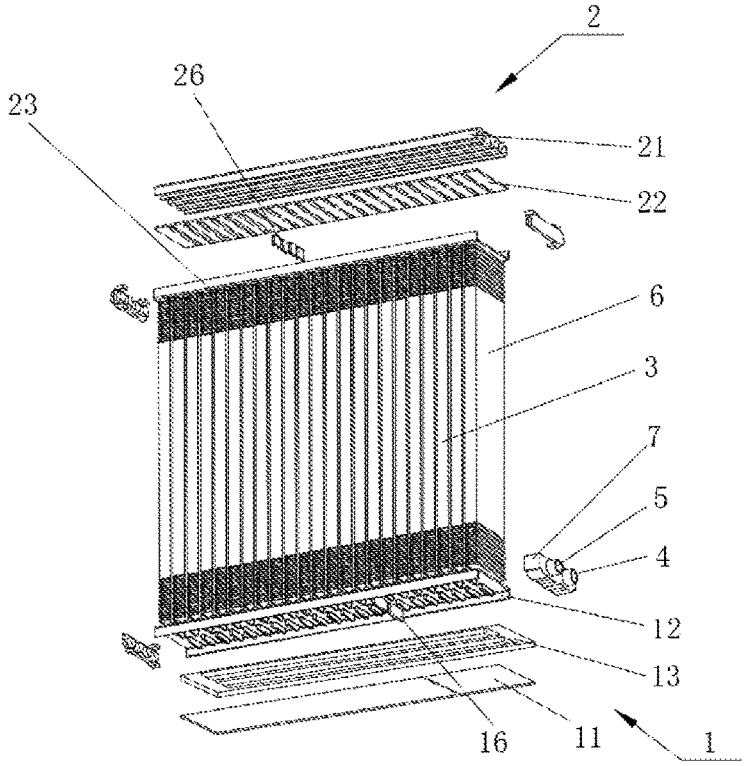
FIG. 11 is a schematic structural view of a heat exchanger in a fifth embodiment of the present disclosure.

In one embodiment, referring to FIG. 11, two first partitions 16 are provided on the first collecting pipe 1 of this embodiment, and the first partitions 16 are arranged side by side. At this time, a plurality of corresponding partition slots can be opened on the first upper main board 11, and the first partitions 16 can be inserted into the partition slots. The first partitions 16 separate each of the first channel 14 and the second channel 15 into two parts. The end cap 8 is connected to one end of the first collecting pipe 1. The inlet 4 and the outlet 5 are connected to the same end of the first channel 14 and the second channel 15, respectively.

In this embodiment, along a horizontal direction, the above-mentioned first partitions 16 are disposed adjacent to the inlet 4. The fourth partitions 26 are located on a side of the first partitions 16 away from the inlet 4, that is, the first partitions 16 are closer to the inlet 4 than the fourth partitions 26. In this way, the channel length of the second collecting pipe 2 on a first side of the fourth partitions 26 (a right side shown in FIG. 11) is longer than that of the first collecting pipe 1 on the first side of the first partitions 16 (a right side shown in FIG. 11). With the above structure, a six-process heat exchange structure of the heat exchanger can be realized.

The rest of the structure of this embodiment is the same as that of the fourth embodiment, so it will not be repeated here.

The operation principle of the six-process heat exchange structure of the heat exchanger in this embodiment is described below:

Firstly, the refrigerant fluid enters a part of the first channel 14 located on the first side (the right side shown in FIG. 11) of the first partitions 16 through the inlet 4, and the refrigerant fluid enters a first process. The refrigerant fluid enters the rear flat tubes 3 and flows upward along the rear flat tubes 3. At this time, the air and the refrigerant fluid exchange heat, the refrigerant fluid evaporates and absorbs heat, part of the liquid evaporates into steam, and the dryness increases. The refrigerant fluid enters the third channel 24 of the second collecting pipe 2 along the rear flat tubes 3 and enters a second process. In the second process, because of the fourth partitions 26, the refrigerant fluid enters a part of the first channel 14 on the second side (the left side shown in FIG. 11) of the first partitions 16 through a part of the rear flat tubes 3, and the refrigerant fluid in this process further evaporates and absorbs heat. Subsequently, the refrigerant enters from the rear flat tubes 3 which are away from the first partitions 16 and have not previously entered the refrigerant, and flows upward along the rear flat tubes 3 to enter a third process. In this third process, the refrigerant fluid enters a part of the third channel 24 on the second side (the left side shown in FIG. 11) of the fourth partitions 26 through a part of the rear flat tubes 3, and the refrigerant fluid evaporates and absorbs heat, part of the liquid evaporates into steam, and the dryness increases. After that, the refrigerant flows from the part of the third channel 24 on the second side (the left side shown in FIG. 11) of the fourth partitions 26 into a part of the fourth channel 25 on the second side (the left side shown in FIG. 11) of the fourth partitions 26 (through the fifth slots 222), and enters a fourth process. In the fourth process, the refrigerant flows downwardly through the front flat tubes 3 and evaporates and absorbs heat, and then flows into a part of the second channel 15 on the second side (the left side shown in FIG. 11) of the first partitions 16. After that, the refrigerant flows into a part of the front flat tubes 3 on the side of the first partitions 16 adjacent to the inlet 4, and flows upwardly along a part of the front flat tubes 3, and enters a fifth process. The refrigerant further evaporates and absorbs heat when flowing upwardly. When the refrigerant in the fifth process flows into a part of the fourth channel 25 on the first side (the right side shown in FIG. 11) of the fourth partitions 26, the refrigerant will flow in the part of the fourth channel 25 along a side away from the fourth partitions 26, flow downwardly into a part of the front flat tubes 3 which correspond to a part of the second channel 15 on the first side (the right side shown in FIG. 11) of the first partitions 16, and finally flow into the part of the second channel 15 on the first side (the right side shown in FIG. 11) of the first partitions 16, and the refrigerant enters a sixth process. In the sixth process, the refrigerant further evaporates and absorbs heat and eventually forms steam, and then the steam flows out through the outlet 5 to complete a heat exchange process.

Sixth Embodiment

Figure 12:
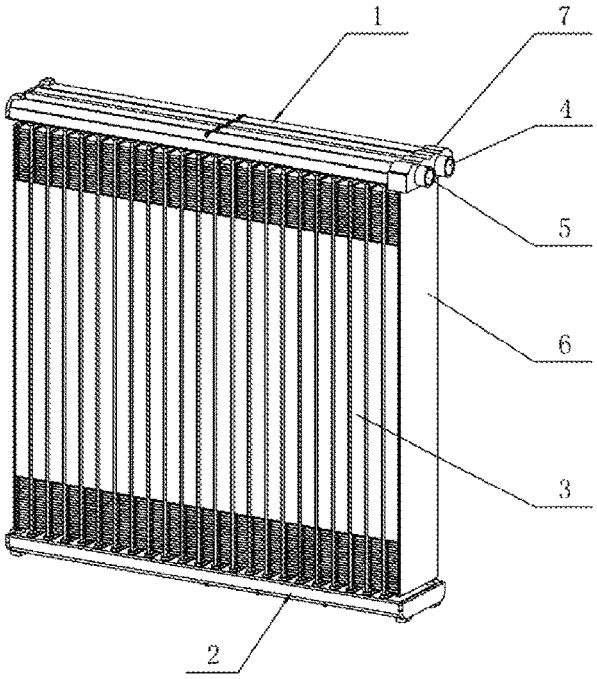
FIG. 12 is a schematic perspective structural view of a heat exchanger in a sixth embodiment of the present disclosure.
Figure 13:
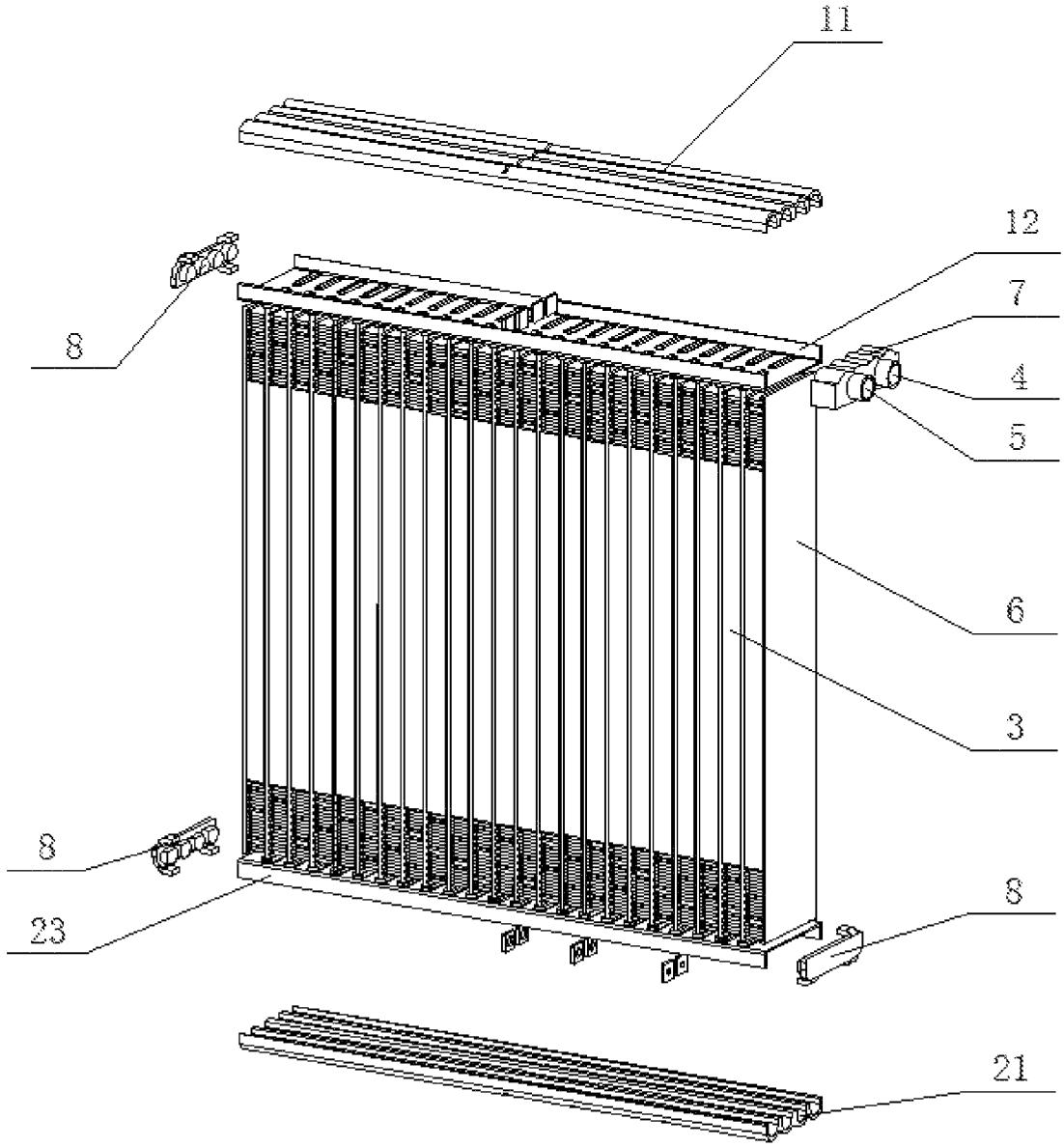
FIG. 13 is an exploded schematic view of the heat exchanger in the sixth embodiment of the present disclosure.

This embodiment provides a heat exchanger. As shown in FIGS. 12 and 13, the heat exchanger includes a first collecting pipe 1, a second collecting pipe 2, flat tubes 3, fins (not labelled) and side plates 6. The flat tubes 3 are provided in two rows, in which two ends are connected to the first collecting pipe 1 and the second collecting pipe 2, respectively. The above-mentioned fins are connected to the flat tubes 3. The side plates 6 are provided outside of the outermost flat tubes 3. An end cap 7 is also connected to one end of the first collecting pipe 1. The end cap 7 is provided with an inlet 4 and an outlet 5. The inlet 4 is configured to flow into a refrigerant fluid in a gas-liquid two-phase mixed state, and the outlet 5 is configured to flow out of a refrigerant gas.

Figure 14:
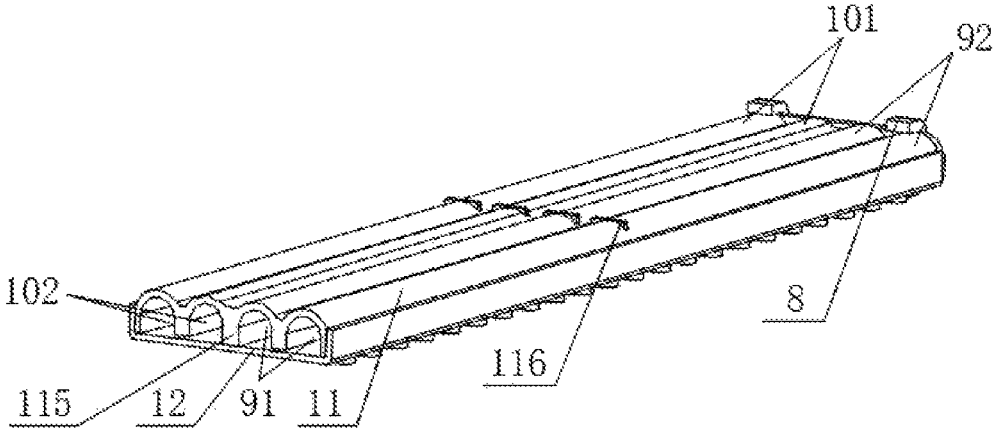
FIG. 14 is a schematic structural view of a first collecting pipe in the sixth embodiment of the present disclosure.
Figure 15:
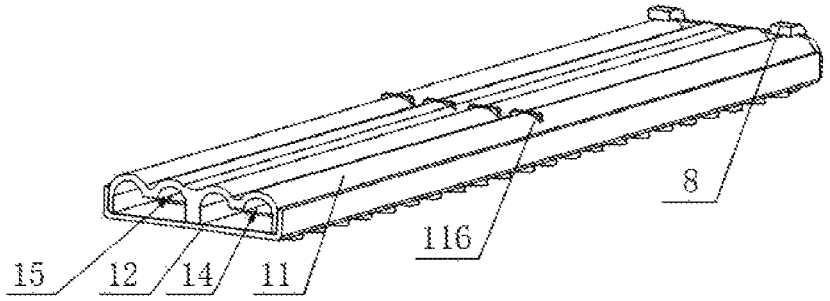
FIG. 15 is a schematic structural view of the first collecting pipe in the sixth embodiment of the present disclosure without first reinforcing ribs.
Figure 16:
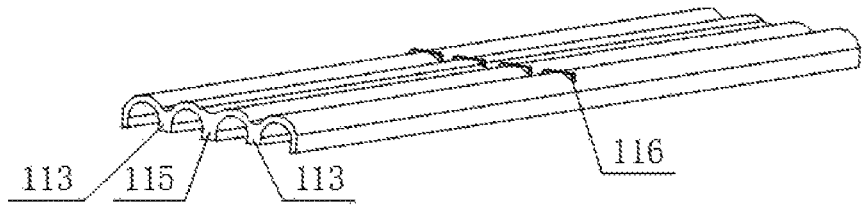
FIG. 16 is a schematic perspective view of a first upper main board of the first collecting pipe with partitions according to the sixth embodiment of the present disclosure.
Figure 17:
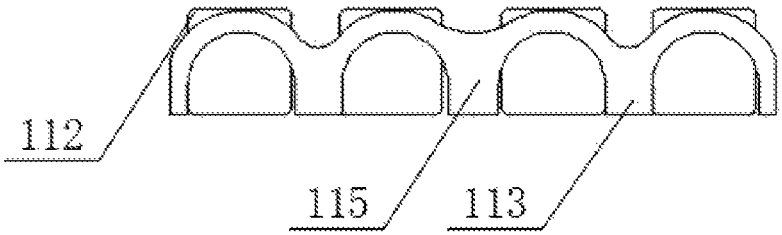
FIG. 17 is a front view of the first upper main board of the first collecting pipe with the partitions according to the sixth embodiment of the present disclosure.
Figure 18:
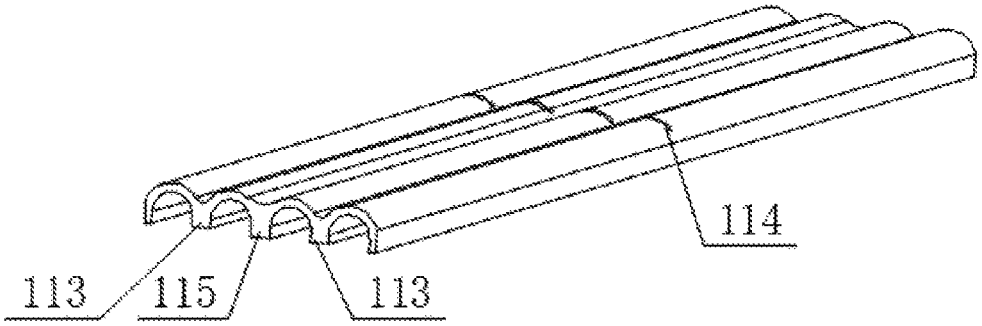
FIG. 18 is a schematic perspective view of the first upper main board of the first collecting pipe without the partitions according to the sixth embodiment of the present disclosure.

Referring to FIG. 14, the first collecting pipe 1 of this embodiment includes a first upper main board 11 and a first lower main board 12 welded together, wherein:

As shown in FIGS. 16-18, the above-mentioned first upper main board 11 has a structure of half Arabic number eight. The first upper main board 11 includes a third middle rib 115 and a plurality of second partitions 116. The third middle rib 115 is supported on the first lower main board 12. The third middle rib 115 is disposed along a length direction of the first upper main board 11, and the third middle rib 115 separates the first upper main board 11 into two through slots. A first channel 14 and a second channel 15 are formed by the two through slots and the first lower main board 12 (shown in FIG. 15). In the two rows of flat tubes 3, the upper ends of one row of flat tubes 3 extend into the above-mentioned first channel 14, and the upper ends of the other row of flat tubes 3 extend into the above-mentioned second channel 15.

In this embodiment, the first collecting pipe 1 further includes a first reinforcing rib 113 which can be supported at the ends of the flat tubes 3. As shown in FIGS. 16 and 17, there are two first reinforcing ribs 113. The two first reinforcing ribs 113 are both arranged along the length direction of the first upper main board 11 and are parallel to the third middle rib 115. The two first reinforcing ribs 113 can increase the strength of the first upper main board 11 and further increase the overall strength of the first collecting pipe 1 so as to withstand the high pressure of the refrigerant fluid with high working pressure. In this embodiment, the two first reinforcing ribs 113 are placed in two through slots, respectively.

In this embodiment, a plurality of sets of partition slots can be formed in each through slot of the first upper main board 11 along the width direction. The second partitions 116 can be inserted into each partition slot. Through the arrangement of multiple sets of second partitions 116, the above-mentioned through slots can be divided into multiple parts. The multiple parts of the through slots are capable of forming at least two chambers together with the first lower main board 12, so that the multi-process operation of the refrigerant can be realized.

Figure 19:
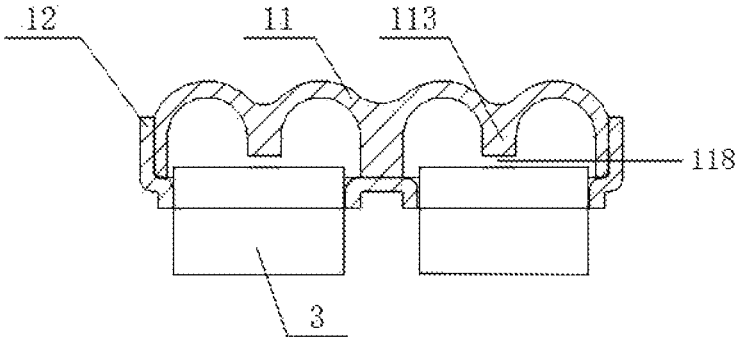
FIG. 19 is a cross-sectional view of the first collecting pipe showing the first reinforcing ribs in the sixth embodiment of the present disclosure.

In this embodiment, referring to FIGS. 16, 18 and 19, the second partitions 116 are provided as a group. A plurality of partition slots 114 are provided in the middle of each through slot of the first upper main board 11, and the above-mentioned second partitions 116 are inserted into the partition slots 114. Through the second partitions 116, each through slot can be divided into two parts, and each part of the through slot forms a cavity with the first lower main board 12 described above. That is, the first collecting pipe 1 in this embodiment is formed with four chambers. As shown in FIG. 14, the first channel 14 includes a first chamber 91 and a second chamber 92, and the second channel 15 includes a third chamber 101 and a fourth chamber 102. The first chamber 91 is communicated with the inlet 4, the second chamber 92 is communicated with the third chamber 101, and the fourth chamber 102 is communicated with the outlet 5. In one embodiment, the second chamber 92 and the third chamber 101 are communicated with each other which can be realized by forming a first through hole or a second through slot 118 at one end of the third middle rib 115 at a position corresponding to the second chamber 92 and the third chamber 101, or by cutting out part of the third middle rib 115. In one embodiment, one end of the third middle rib 115 is provided with a second through hole or a third through slot 119, and the first channel 14 and the second channel 15 are communicated with each other through the second through hole or the third through slot 119.

Moreover, since each through slot is provided with a first reinforcing rib 113 which separates each through slot into two sub-slots. Therefore, in this embodiment, by forming a through hole in the first reinforcing rib 113, or forming a slot at a lower end of the first reinforcing rib 113, or cutting off a part of the lower end of the first reinforcing rib 113, the two sub-slots can be achieved to communicate with each other (as shown in FIG. 19, the two sub-slots are communicated by cutting off a part of the first reinforcing rib 113). In this embodiment, four of the above-mentioned partition slots 114 are provided which are respectively opened at the middle position of each sub-slot. Accordingly, four second partitions 116 are also provided.

Figure 20:
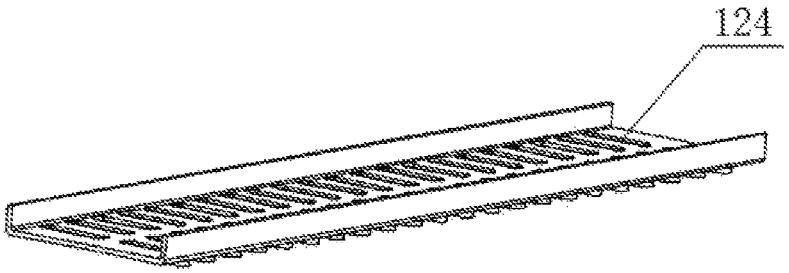
FIG. 20 is a schematic perspective view of a first lower main board of the first collecting pipe in the sixth embodiment of the present disclosure.
Figure 21:
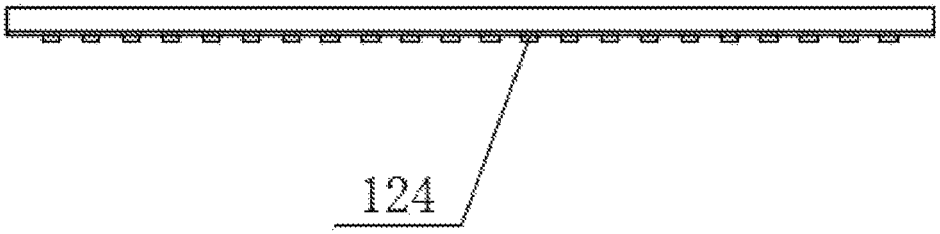
FIG. 21 is a front view of the first lower main board of the first collecting pipe in the sixth embodiment of the present disclosure.

As shown in FIGS. 20 and 21, the first lower main board 12 of this embodiment is of a U-shaped configuration, and the first lower main board 12 is provided with two rows of second flat tube slots 124. The second flat tube slots 124 are obtained by punching with a punch. The shape and size of the second flat tube slots 124 match the shape and size of the flat tubes 3. The upper ends of the flat tubes 3 is sealed through the second flat tube slots 124 and placed in the first channel 14 and the second channel 15. In one embodiment, after the upper ends of the flat tubes 3 pass through the second flat tube slots 124, the flat tubes 3 are welded in the second flat tube slots 124 by brazing. The above-mentioned second flat tube slots 124 adopt a structure of outward burring (specifically burring downwardly toward the first lower main board 12), which increases the contact area with the flat tubes 3, thereby increasing the connection strength between the second flat tube slots 124 and the flat tubes 3. In this embodiment, the length of the second flat tube slots 124 is greater than of the shrinkage width of the flat tubes 3 by 0.05 mm to 0.1 mm. The width of the second flat tube slots 124 is greater than the thickness of the flat tubes 3 by 0.05 mm to 0.12 mm. The height of the burring of the second flat tube slots 124 is 0.7-1.3 times of the thickness of the flat tubes 3.

In this embodiment, an end of the first collecting pipe 1 that is not connected to the end cap 7 is provided with a blocking cap 8 to close the end of the first collecting pipe 1.

Figure 22:
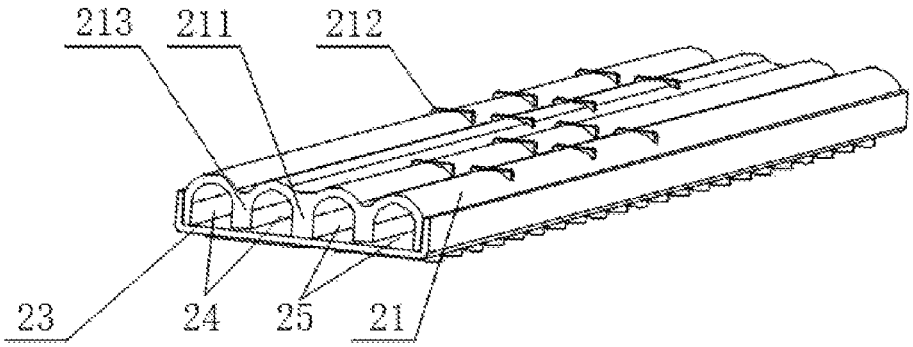
FIG. 22 is a schematic perspective structural view of a second collecting pipe in the sixth embodiment of the present disclosure.
Figure 23:
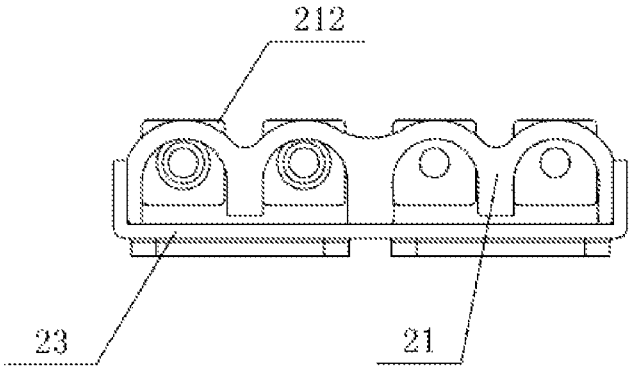
FIG. 23 is a front view of the second collecting pipe in the sixth embodiment of the present disclosure.
Figure 24:
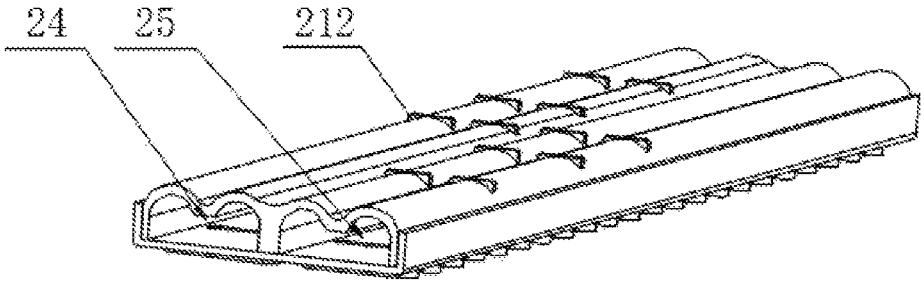
FIG. 24 is a schematic structural view of the second collecting pipe in the sixth embodiment of the present disclosure without second reinforcing ribs.

In this embodiment, as shown in FIGS. 22 to 24, the second collecting pipe 2 includes a second lower main board 21 and a second upper main board 23. The second upper main board 23 is wrapped around the second lower main board 21, and fixed together by welding so as to form the second collecting pipe 2.

Referring to FIGS. 22 and 24, the second lower main board 21 and the second upper main board 23 are formed with a third channel 24 and a fourth channel 25. The lower ends of the two rows of flat tubes 3 are communicated with the third channel 24 and the fourth channel 25, respectively.

In one embodiment, the above-mentioned second lower main board 21 has a structure of half Arabic number eight. The second lower main board 21 includes a fourth middle rib 211, a plurality of flow equalizing plates 212 and a second reinforcing rib 213. The fourth middle rib 211 is provided along the length direction of the second lower main board 21, and the fourth middle rib 211 separates the second lower main board 21 into two through slots. The two through slots encloses with the second upper main board 23 to form the third channel 24 and the fourth channel 25 described above. In the two rows of flat tubes 3, the lower ends of one row of flat tubes 3 extend into the third channel 24, and the lower ends of the other row of flat tubes 3 extend into the fourth channel 25. In this embodiment, the above-mentioned third channel 24 is provided corresponding to the first channel 14 of the first collecting pipe 1. The fourth channel 25 is provided corresponding to the second channel 15 of the first collecting pipe 1.

There are two second reinforcing ribs 213 supported on the ends of the flat tubes 3. The two second reinforcing ribs 213 are both arranged along the length direction of the second lower main board 21 and are parallel to the fourth middle rib 211. The two second reinforcing ribs 213 can increase the strength of the above-mentioned second lower main board 21, and thus also increase the overall strength of the second collecting pipe 2 in order to withstand the high pressure of the refrigerant fluid of high working pressure. In this embodiment, the above two second reinforcing ribs 213 are respectively placed in two through slots of the second lower main board 21, and the second reinforcing rib 213 divides each through slot into two mutually connected sub-slots. In one embodiment, the two sub-slots can be communicated by opening a through hole in the second reinforcing rib 213 or grooving the lower end of the second reinforcing rib 213 or cutting off a part of the second reinforcing rib 213.

Referring to FIGS. 22 to 24, each sub-slot of the second lower main board 21 is provided with a plurality of equalizing plate holes along its length (not shown in the figure). The above-mentioned flow equalizing plates 212 are inserted into the equalizing plate holes. A plurality of flow distribution holes (not shown in the figure) are provided on the flow equalizing plates 212, and the areas of the flow distribution holes of the plurality of flow equalizing plates 212 on the above-mentioned are sequentially reduced along the refrigerant fluid flow direction, in order to realize the throttling and distribution of the refrigerant fluid, thus the refrigerant fluid can evenly flow into the plurality of flat tubes 3.

In this embodiment, the structure of the second upper main board 23 is exactly the same as the structure of the first lower main board 12, so the structure will not be repeated here. The second upper main board 23 can fix the second lower main board 21 to form the second collecting pipe 2. The second upper main board 23 can fix the second lower main board 21 to form the second collecting pipe 2.

In this embodiment, both ends of the second collecting pipe 2 are provided with blocking caps 8 to close the ends of the second collecting pipe 2.

The operating principle of the above heat exchanger in this embodiment is as follows:

First, the refrigerant fluid enters the first chamber 91 of the first collecting pipe 1 through the inlet 4. At this time, the refrigerant fluid enters a first process. The refrigerant fluid enters the rear flat tubes 3 and flows downwardly along the rear flat tubes 3. At this time, the air and the refrigerant fluid exchange heat, the refrigerant fluid evaporates and absorbs heat, part of the liquid evaporates into steam, and the dryness increases. The refrigerant fluid enters the third channel 24 of the second collecting pipe 2 along the rear flat tubes 3. Areas of the equalizing holes of the flow equalizing plates 212 in the third channel 24 sequentially decrease along the flow direction so as to partly throttle the refrigerant fluid, adjust the distribution, and the refrigerant fluid enters a second process. In the second process, the refrigerant fluid enters the second chamber 92 of the first collecting pipe 1 through the rear flat tubes 3, and further evaporates and absorbs heat during this process. Subsequently, the refrigerant fluid enters the third chamber 101 of the first collecting pipe 1 communicating with the second chamber 92, and enters a third process. In the third process, the refrigerant fluid enters the front flat tubes 3, and further evaporates and absorbs heat, and enters the fourth channel 25 of the second collecting pipe 2. Areas of the equalizing holes of the flow equalizing plates 212 in the fourth channel 25 sequentially decrease along the flow direction so as to partly throttle the refrigerant fluid, adjust the distribution, and the refrigerant fluid enters a fourth process. In the fourth process, the refrigerant fluid flows into the fourth chamber 102 of the first collecting pipe 1 through the front flat tubes 3. The refrigerant fluid further exchanges heat with the air during the flow process and evaporates into steam. Subsequently, the steam flows out through the outlet 5 to complete a heat exchange process.

The structure of the first collecting pipe 1 and the second collecting pipe 2 of this embodiment can meet the high strength requirements of the heat exchanger when using a refrigerant fluid with high working pressure. Moreover, with the above-mentioned first collecting pipe 1 and second collecting pipe 2 having a more compact size, the heat exchanger of this embodiment has a larger windward area under the same external dimensions.

This embodiment also provides an air conditioner that uses the heat exchanger described in this embodiment as an evaporator, which can realize efficient heat exchange in a compact space of the air conditioner.

Seventh Embodiment

This embodiment provides a heat exchanger, which differs from the sixth embodiment in that the structure of the first collecting pipe 1 of this embodiment is different. Therefore, in this embodiment only the structure of the first collecting pipe 1 is described. Since the remaining structure is the same as that of the sixth embodiment, it will not be described in detail.

Figure 25:
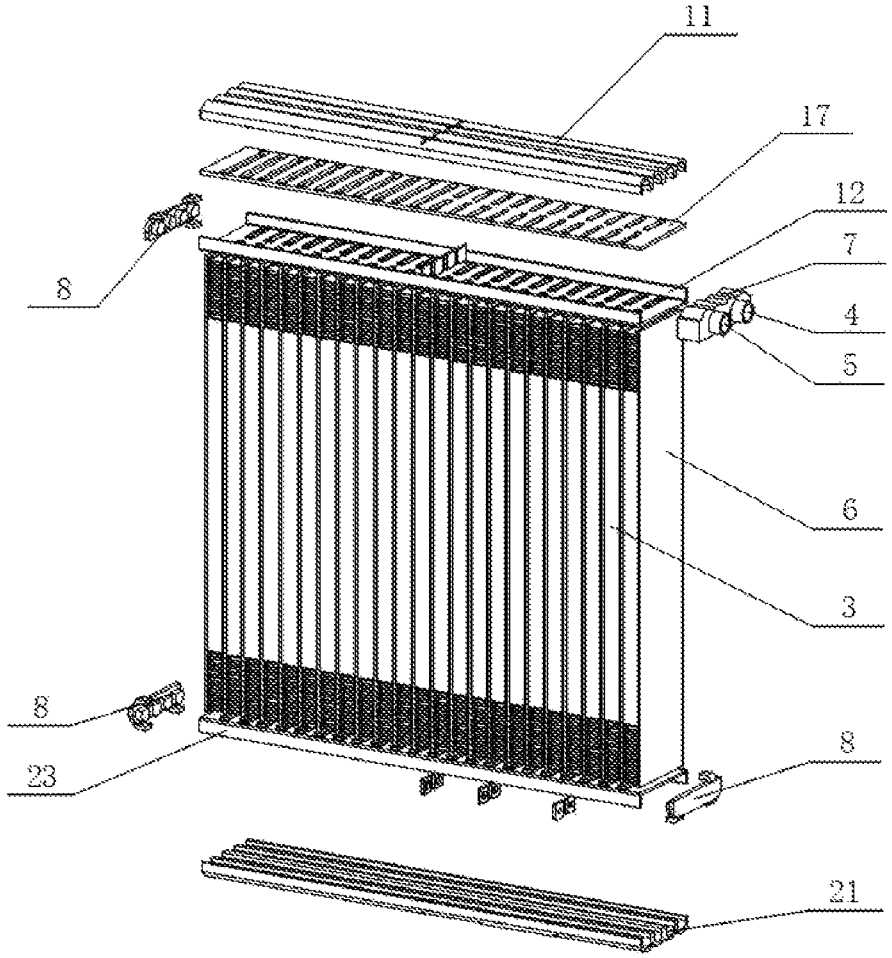
FIG. 25 is an exploded schematic view of a heat exchanger in a seventh embodiment of the present disclosure.
Figure 26:
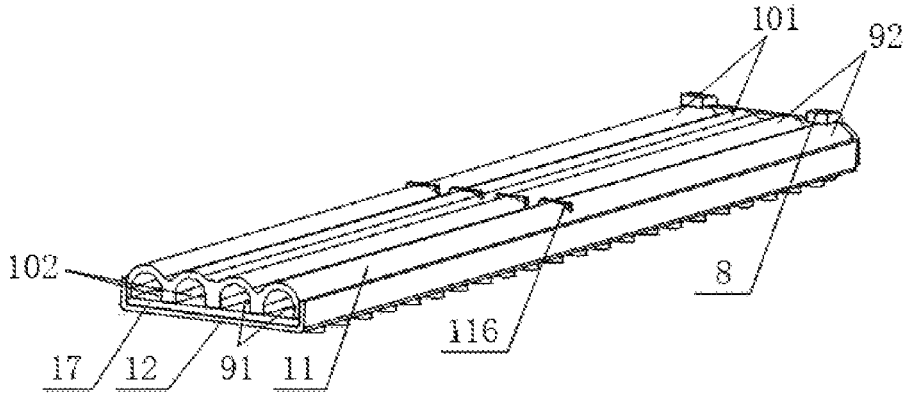
FIG. 26 is a schematic structural view of a first collecting pipe in the seventh embodiment of the present disclosure.
Figure 27:
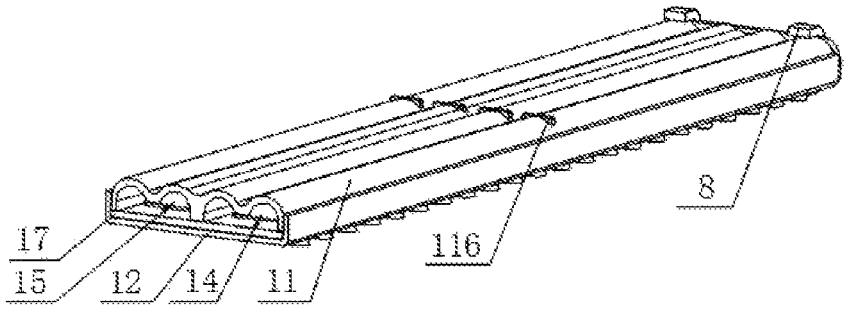
FIG. 27 is a schematic structural view of the first collecting pipe in the seventh embodiment of the present disclosure without first reinforcement ribs.

Referring to FIGS. 25 to 27, the first collecting pipe 1 of this embodiment includes a first upper main board 11, a second intermediate main board 17 and a first lower main board 12 that are sequentially arranged along a top-to-bottom direction. In one embodiment, the first lower main board 12 is wrapped around the first upper main board 11 and the second intermediate main board 17 and fixed together by welding to form the first collecting pipe 1. Moreover, in this embodiment, the third middle rib 115 and the first reinforcing rib 113 of the first upper main board 11 are both supported on the second intermediate main board 17. Neither the third middle rib 115 nor the first reinforcing rib 113 needs to be holed, slotted or partly cut off. The communication between the second chamber 92 and the third chamber 101 of this embodiment is through the second intermediate main board 17 described above.

Figure 28:
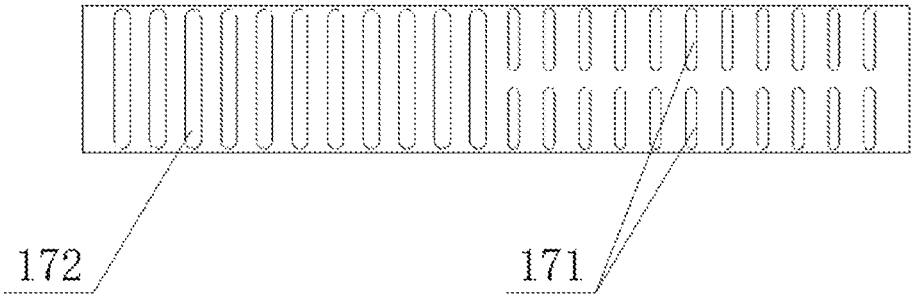
FIG. 28 is a schematic structural view of a first intermediate main board of the first collecting pipe in the seventh embodiment of the present disclosure.

As shown in FIG. 28, two rows of second slots 171 and a row of third slots 172 are formed on the second intermediate main board 17. The two rows of second slots 171 are located at the bottom of the first chamber 91 and the fourth chamber 102, respectively. Both of the two rows of second slots 171 are located at one side of the second partitions 116.

Figure 29:
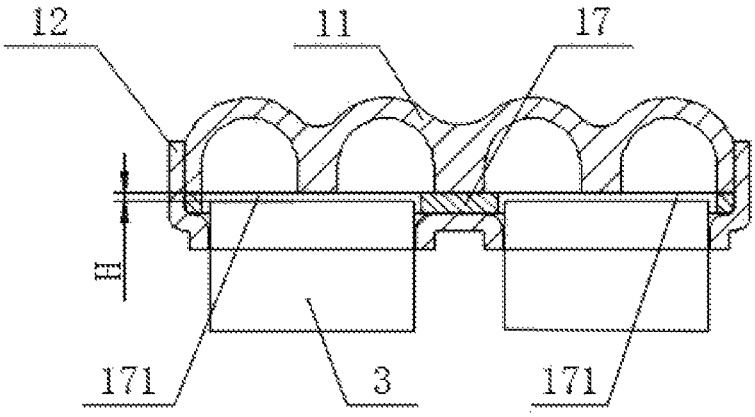
FIG. 29 is a cross-sectional view of the first collecting pipe in the seventh embodiment of the present disclosure showing first slots.

The upper ends of a part of the flat tubes 3 in the two rows of flat tubes 3 are respectively placed in the two rows of second slots 171. The length of the third slots 172 is longer than that of the second slots 171. The row of third slots 172 is located on the other side of the second partitions 116. In one embodiment, gaps between the second slots 171 and the periphery of the flat tubes 3 are relatively large. The length of the second slots 171 is greater than the width of the flat tubes 3 by 0.4 mm to 3 mm, and the width is greater than the thickness of the flat tubes 3 by 0.4 mm to 3 mm. Referring to FIG. 29, the first upper main board 11 is placed on the second intermediate main board 17. A distance H between the upper ends of the flat tubes 3 and the first reinforcing rib 113 of the first upper main board 11 is half the thickness of the second intermediate main board 17. In this embodiment, the distance H between the upper ends of the flat tubes 3 and the first reinforcing rib 113 of the first upper main board 11 is 1 mm to 3 mm. With the above structure, the two sub-slots of the same through slot can be communicated with each other through the second slots 171 (that is, there is no need for the first reinforcing rib 113 to be opened, slotted or partly cut off). The refrigerant fluid in the two sub-slots can enter the flat tubes 3 through the second slots 171, and the refrigerant fluid in the flat tubes 3 can enter the through slots through the second slots 171.

Figure 30:
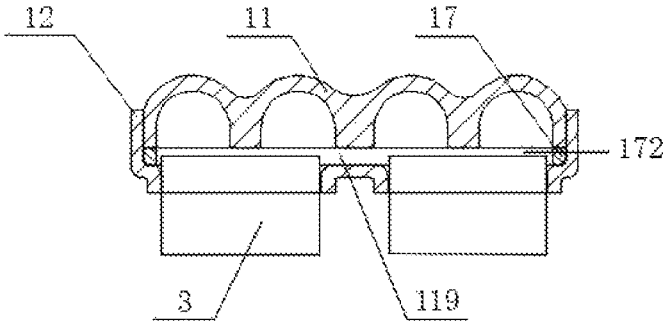
FIG. 30 is a cross-sectional view of the first collecting pipe in the seventh embodiment of the present disclosure showing second slots.

The above-mentioned third slots 172 are correspondingly disposed at the second chamber 92 and the third chamber 101. The second chamber 92 and the third chamber 101 are communicated with each other through the third slots 172. The upper ends of the other part of the flat tubes 3 in the two rows of flat tubes 3 are placed in the third slots 172. Referring to FIG. 30, when the refrigerant fluid flows into the second chamber 92 from the rear flat tubes 3, the refrigerant fluid will flow into the third chamber 101 through the third slots 172 and flow into the front flat tubes 3, so as to achieve the communication of two rows of flat tubes 3.

The first collecting pipe 1 of this embodiment is composed of three main boards, which can further meet the high strength requirements of the heat exchanger when using a refrigerant fluid with high working pressure.

This embodiment also provides an air conditioner that uses the heat exchanger described in this embodiment as an evaporator, which can realize efficient heat exchange in a compact space of the air conditioner.

Eighth Embodiment

This embodiment provides a heat exchanger, which differs from the sixth embodiment in that the structure of the second collecting pipe 2 of this embodiment is different. Therefore, in this embodiment, only the structure of the first collecting pipe 2 will be described. Since the remaining structures are the same as those in the sixth embodiment, it will not be repeated here.

Figure 31:
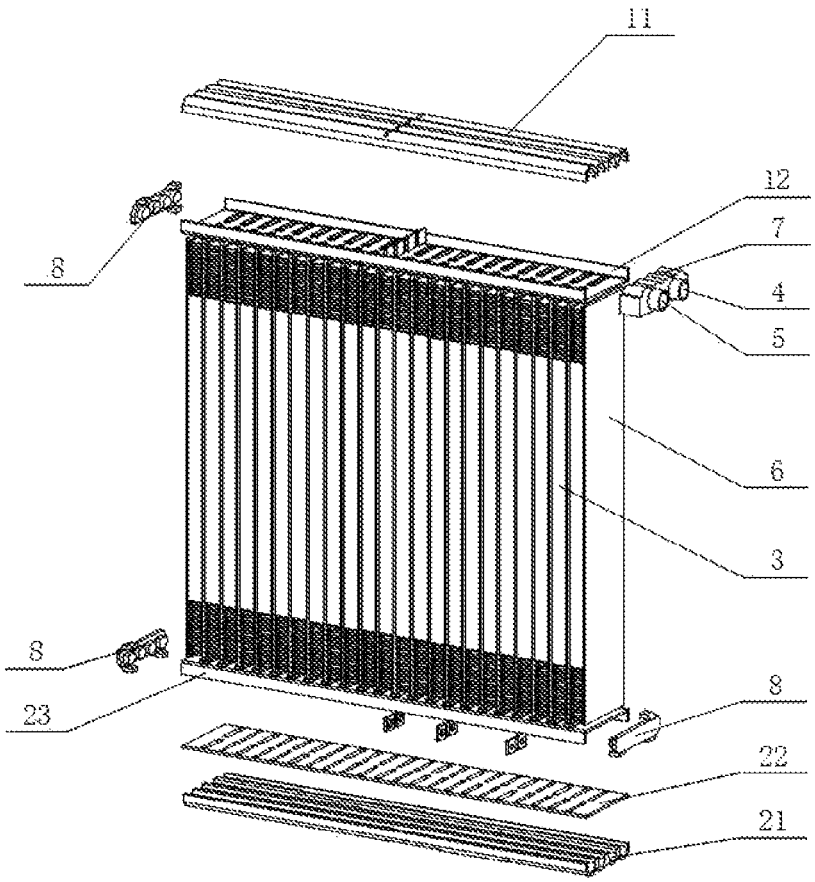
FIG. 31 is an exploded schematic view of a heat exchanger in an eighth embodiment of the present disclosure.
Figure 32:
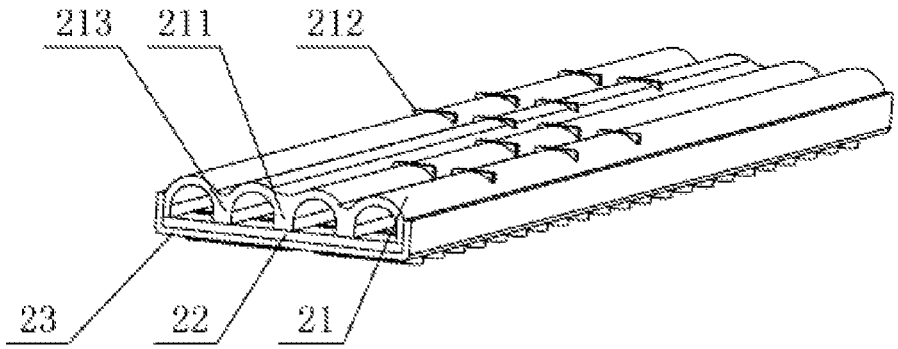
FIG. 32 is a schematic perspective view of a second collecting pipe in the eighth embodiment of the present disclosure.

In one embodiment, as shown in FIGS. 31 and 32, the second collecting pipe 2 includes a second lower main board 21, a third intermediate main board 22 and a second upper main board 23 that are sequentially arranged along a bottom-to-top direction. In one embodiment, the second upper main board 23 is wrapped around the second lower main board 21 and the third intermediate main board 22, and fixed together by welding to form the second collecting pipe 2. Moreover, in this embodiment, the fourth middle rib 211 and the first reinforcing rib 213 of the second lower main board 21 are both supported on the second intermediate main board 22, and neither the fourth middle rib 211 nor the first reinforcing rib 213 needs to be holed, slotted or partly cut off.

Figure 33:
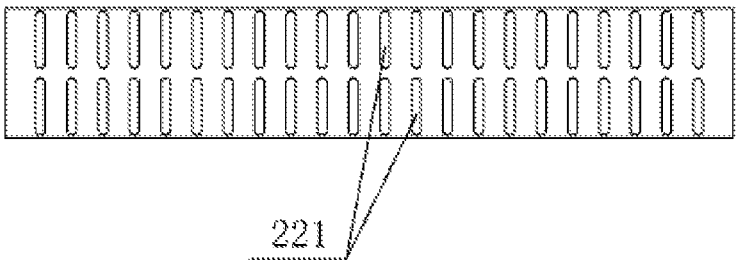
FIG. 33 is a schematic structural view of a second intermediate main board of the second collecting pipe in the eighth embodiment of the present disclosure.

As shown in FIG. 33, the second intermediate main board 22 is provided with two rows of fourth slots 221, and the two rows of fourth slots 221 are located in the third channel 24 and the fourth channel 25, respectively. The shape and size of the fourth slots 221 are the same as those of the second slots 171. The length of the fourth slots 221 is greater than the width of the flat tubes 3 by 0.4 mm to 3 mm, and the width of the fourth slots 221 is greater than the thickness of the flat tubes 3 by 0.4 mm to 3 mm.

The lower ends of the flat tubes 3 are placed in the fourth slots 221. The distance between the ends of the flat tubes 3 placed in the fourth slots 221 and the second reinforcing rib 213 of the second lower main board 21 is half the thickness of the third intermediate main board 22. With the above structure, the refrigerant fluid in the through slot of the second lower main board 21 can enter the flat tubes 3 through the fourth slots 221, and the refrigerant fluid in the flat tubes 3 can enter the through slot of the second lower main board 21 through the fourth slots 221.

The second collecting pipe 2 of this embodiment is composed of three main boards, which can further meet the high strength requirements of the heat exchanger when using a refrigerant fluid with high working pressure.

This embodiment also provides an air conditioner that uses the heat exchanger described in this embodiment as an evaporator, which can realize efficient heat exchange in a compact space of the air conditioner.

Ninth Embodiment

Figure 34:
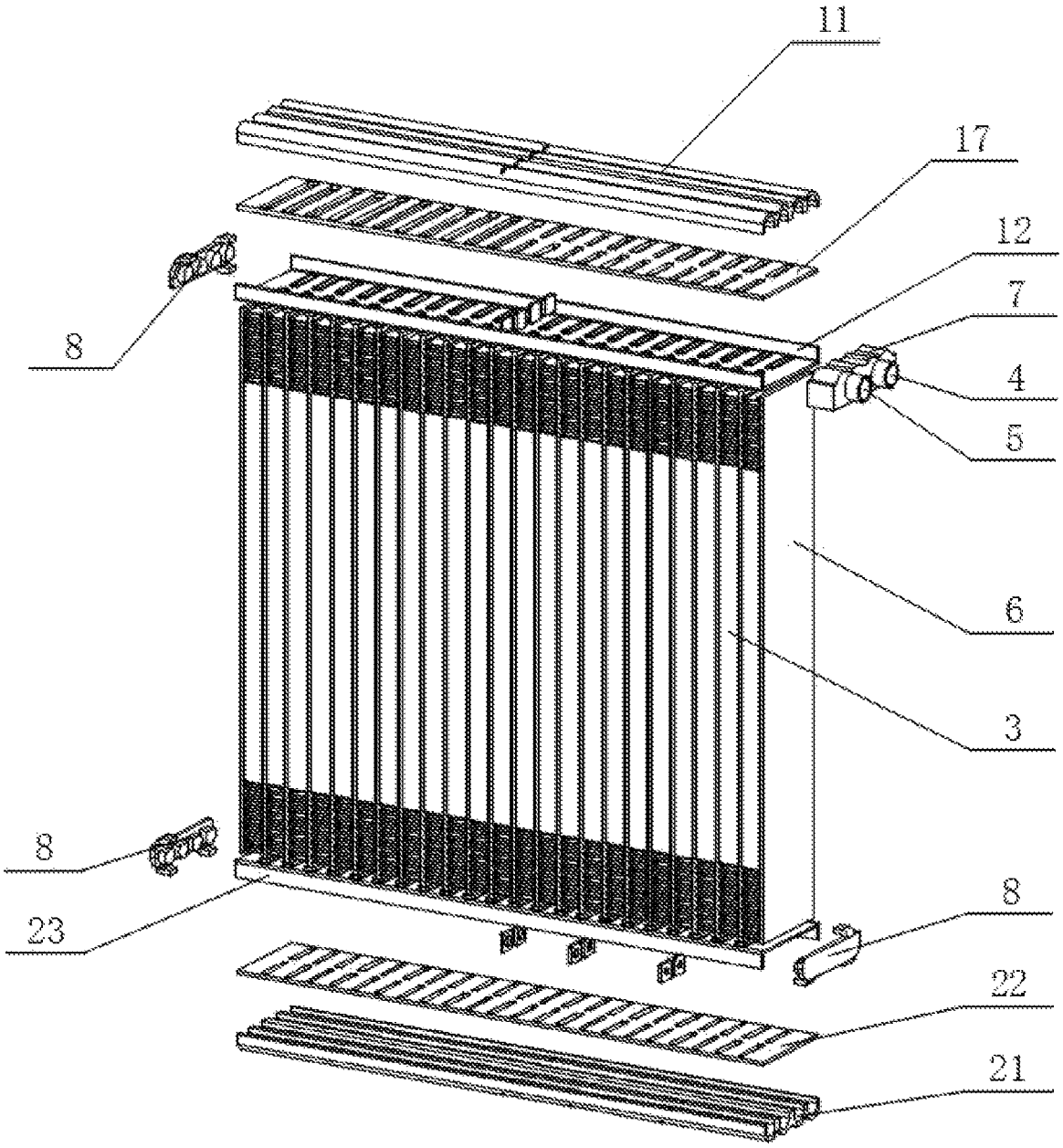
FIG. 34 is an exploded schematic view of a heat exchanger in a ninth embodiment of the present disclosure.

This embodiment provides a heat exchanger, which differs from the sixth embodiment in that the structures of the first collecting pipe 1 and the second collecting pipe 2 of this embodiment are different. The structure of the first collecting pipe 1 of this embodiment is the same as the structure of the first collecting pipe 1 described in the seventh embodiment, and the structure of the second collecting pipe 2 is the same as the structure of the second collecting pipe 2 described in the eighth embodiment. The rest of the structures of this embodiment is the same as those of the sixth embodiment, which will not be repeated here. A schematic view of the heat exchanger of this embodiment can be referred to FIG. 34.

The first collecting pipe 1 and the second collecting pipe 2 of this embodiment are both composed of three main boards, which can further meet the high strength requirements of the heat exchanger when using a refrigerant fluid with high working pressure.

This embodiment also provides an air conditioner that uses the heat exchanger described in this embodiment as an evaporator, which can realize efficient heat exchange in a compact space of the air conditioner.

Tenth Embodiment

This embodiment provides a heat exchanger, which differs from the ninth embodiment in that the structure of the second collecting pipe 2 in this embodiment is different, and the mounting positions of the end cap 7 and the inlet 4 and outlet 5 thereon are different in this embodiment.

Figure 35:
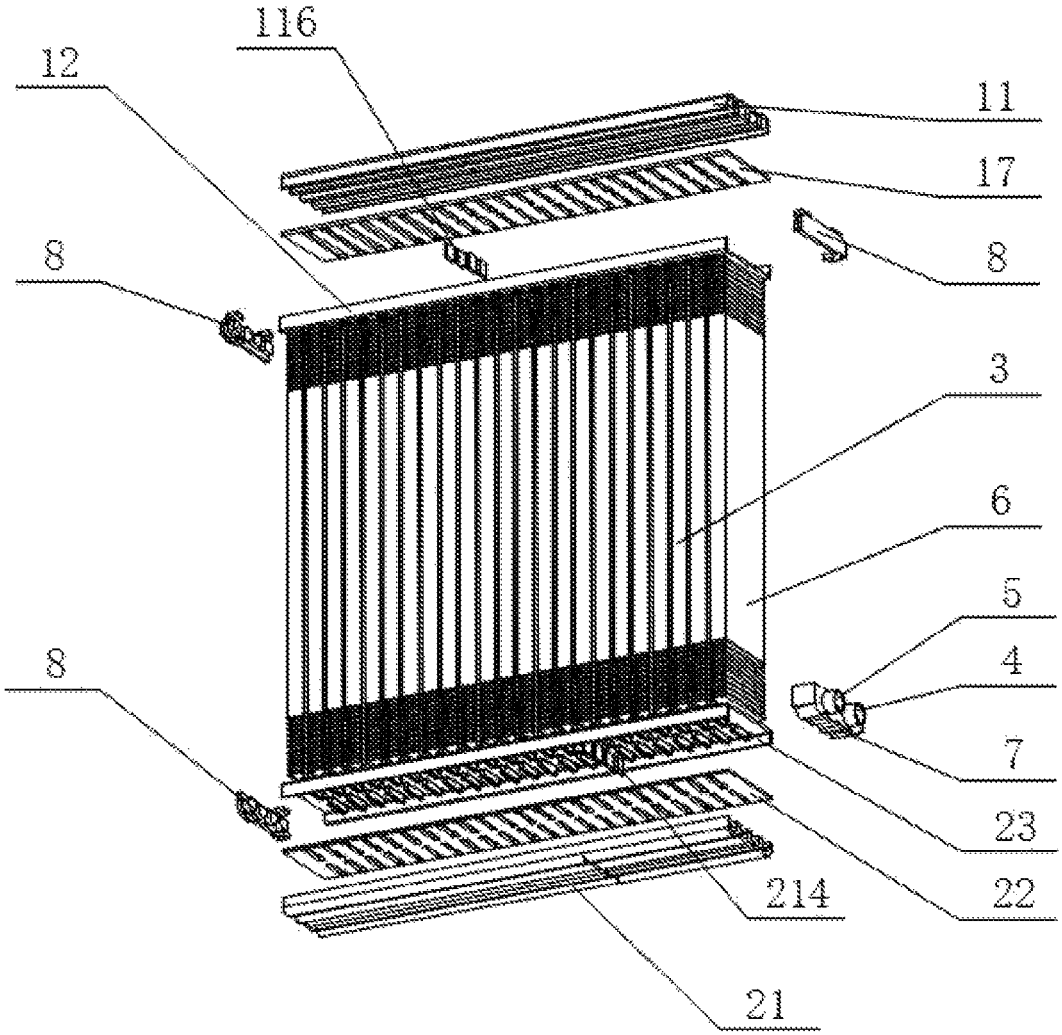
FIG. 35 is an exploded schematic view of a heat exchanger in a tenth embodiment of the present disclosure.

In one embodiment, referring to FIG. 35, the second collecting pipe 2 of this embodiment is provided with a plurality of third partitions 214 arranged side by side. At this time, a plurality of corresponding partition slots can be opened on the second lower main board 21, and the third partitions 214 can be inserted into the partition slots. The plurality of third partitions 214 can separate the two through slots of the second lower main board 21 into two parts, and each part of the through slots forms a chamber with the second intermediate main board 22 and the second upper main board 23. That is to say, in this embodiment, both the third channel 24 and the fourth channel 25 are formed with two chambers. One end of the second collecting pipe 2 is connected with the end cap 7, and the inlet 4 and the outlet 5 are communicated with the chambers at the same end of the third channel 24 and the fourth channel 25, respectively.

In this embodiment, the third partitions 214 are located adjacent to the inlet 4. The second partitions 116 are located on the side of the third partitions 214 away from the inlet 4. That is, the third partitions 214 are closer to the inlet 4 than the second partitions 116. This makes the length of the chamber of the first collecting pipe 1 be greater than the length of the chamber of the second collecting pipe 2, in the chambers of the first collecting pipe 1 and the second collecting pipe 2 on the same side. With the above structure, a six-process heat exchange structure of the heat exchanger can be realized.

The rest of the structure of this embodiment is the same as that of the ninth embodiment, so it will not be repeated here.

The operation principle of the six-process heat exchange structure of the heat exchanger in this embodiment is as follows:

Firstly, the refrigerant fluid enters a chamber of the third channel 24 through the inlet 4. At this time, the refrigerant fluid enters the first process. The refrigerant fluid enters the rear flat tubes 3 and flows upwardly along the rear flat tubes 3. At this time, the air and the refrigerant fluid exchange heat, the refrigerant fluid evaporates and absorbs heat, part of the liquid evaporates into steam, and the dryness increases. The refrigerant fluid enters the first chamber 91 of the first collecting pipe 1 along the rear flat tubes 3 and thus the refrigerant fluid enters the second process. Because of the second partitions 116, the refrigerant fluid in the second process enters the other chamber of the second collecting pipe 2 through a part of the flat tubes 3 communicating with the other chamber of the third channel 24 in the rear row, and the refrigerant fluid further evaporates and absorbs heat during this process. Subsequently, the refrigerant fluid in the other chamber of the second collecting pipe 2 flows from a side close to the third partitions 214 to a side far away from the third partitions 214. The refrigerant fluid enters the rear flat tubes 3 which are on the side away from the third partitions 214 and have not entered the refrigerant fluid, and refrigerant fluid flows upwardly along the rear flat tubes 3 to enter a third process. In the third process, the refrigerant fluid enters the second chamber 92 of the first collecting pipe 1 along the rear flat tubes 3. The refrigerant fluid evaporates and absorbs heat, part of the liquid evaporates into steam, and the dryness increases. After that, the refrigerant enters the third chamber 101 communicating with the second chamber 92 through the third slots 172 from the second chamber 92, and enters a fourth process. In the fourth process, the refrigerant flows downwardly through the front flat tubes 3, evaporates and absorbs heat, and flows into a chamber of the fourth channel 25. After that, the refrigerant flows into a part of the front flat tubes 3 on a side of the third partitions 214 near the inlet 4 through the chamber. The refrigerant flows upwardly along the part of the front flat tubes 3 to enter a fifth process. The refrigerant further evaporates and absorbs heat when flowing upwardly. When the refrigerant in the fifth process flows into the fourth chamber 102, the refrigerant will flow to a side away from the second partitions 116 in the fourth chamber 102, and the refrigerant will flow downwardly into the front flat tubes 3 corresponding to the other chamber of the fourth channel 25, and then enter the other chamber of the fourth channel 25. That is, the refrigerant enters a sixth process. In the sixth process, the refrigerant further evaporates and absorbs heat and eventually forms steam. Then the steam flows out through the outlet 5 to complete a heat exchange process.

In the heat exchanger of this embodiment, through the first collecting pipe 1 and the second collecting pipe 2 described above, a six-process heat exchange is realized. Moreover, the first collecting pipe 1 and the second collecting pipe 2 are composed of three main boards, which can further meet the high strength requirements of the heat exchanger when using a refrigerant fluid with high working pressure.

This embodiment also provides an air conditioner that uses the above-mentioned heat exchanger as an evaporator, which can realize efficient heat exchange in a compact space of the air conditioner.

Eleventh Embodiment

This embodiment provides a thermal management system including a compressor, a throttling device and the heat exchanger described in any one of the first to tenth embodiments. The heat exchanger is arranged between the compressor and the throttling device, and the heat exchanger can be used as an evaporator or a condenser. Through the above heat exchanger, while working with a refrigerant fluid of high working pressure, the size of the heat exchanger is made more compact, the windward area of the heat exchanger is larger, and the heat exchange performance is higher.

What is claimed is:

1. A heat exchanger comprising:

a first collecting pipe comprising a first upper main board and a first lower main board, the first upper main board and the first lower main board being hermetically connected, a first channel and a second channel being formed between the first upper main board and the first lower main board;

a second collecting pipe provided with a third channel and a fourth channel; and a plurality of flat tubes in two rows, one ends of the flat tubes being communicated with the first channel and the second channel, respectively; and the other ends of the flat tubes being communicated with the third channel and the fourth channel, respectively; wherein the third channel is communicated with the first channel through a row of the flat tubes, and the fourth channel is communicated with the second channel through another row of the flat tubes; wherein the first upper main board has a flat bottom surface, the first lower main board has a flat top surface facing the flat bottom surface, the first channel and the second channel are formed between the flat bottom surface and the flat top surface; wherein a vertical height between a highest point of the first channel and the second channel and a lowest point of the first channel and the second channel is L1, a maximum width of each of the first channel and the second channel is L2, and a ratio of L1 to L2 is not greater than 1:4; and wherein the one ends of the flat tubes protrude into the first channel and the second channel, respectively.

2. The heat exchanger according to claim 1, wherein the first lower main board comprises a pair of side walls bent toward the first upper main board and abutting against the flat bottom surface of the first upper main board, and the first lower main board comprises a first middle rib abutting against the flat bottom surface of the first upper main board; and the first channel and the second channel are formed by the flat top surface of the first lower main board, the side walls, the first middle rib and the flat bottom surface of the first upper main board.

3. The heat exchanger according to claim 1, wherein the first upper main board comprises two grooves each extending along a length direction of the first upper main board, a second middle rib is provided between the two grooves to separate the two grooves, and the first channel and the second channel are formed by the grooves of the first upper main board, the second middle rib and the first lower main board.

4. The heat exchanger according to claim 3, wherein a first intermediate main board is provided between the first upper main board and the first lower main board, and the first intermediate main board is provided with two rows of first slots which are communicated with the first channel and the second channel, respectively.

5. The heat exchanger according to claim 4, wherein the first lower main board is provided with two rows of first flat tube slots each of which is corresponding to one of the first slots, the first intermediate main board is sandwiched by the first upper main board and the first lower main board, and the one ends of the flat tubes are placed in the first slots and sealed through walls which respectively define the first flat tube slots; and wherein the one ends of the flat tubes do not extend beyond the first intermediate main board.

6. The heat exchanger according to claim 1, wherein a first intermediate main board is provided between and sandwiched by the first upper main board and the first lower main board, the first intermediate main board is provided with two first through slots arranged side by side, each first through slot extends along a length direction of the first upper main board, and the first channel and the second channel are formed by the flat bottom surface of the first upper main board, the two first through slots and the flat top surface of the first lower main board.

7. The heat exchanger according to claim 6, wherein the first upper main board, the first intermediate main board and the first lower main board are all of flat plate shapes and are fixed together by welding.

8. A heat exchanger comprising:

a first collecting pipe comprising a first upper main board and a first lower main board, the first upper main board and the first lower main board being hermetically connected, a first channel and a second channel being formed between the first upper main board and the first lower main board;

a second collecting pipe provided with a third channel and a fourth channel; and a plurality of flat tubes in two rows, one ends of the flat tubes being communicated with the first channel and the second channel, respectively; and the other ends of the flat tubes being communicated with the third channel and the fourth channel, respectively; wherein the third channel is communicated with the first channel through a row of the flat tubes, and the fourth channel is communicated with the second channel through another row of the flat tubes; and wherein the first upper main board is provided with two first partitions, and each of the first channel and the second channel is separated into two parts by the corresponding first partition.

9. The heat exchanger according to claim 1, wherein one of the first channel and the second channel is provided with an inlet and the other is provided with an outlet; or one of the third channel and the fourth channel is provided with an inlet, and the other is provided with an outlet.

10. A heat exchanger comprising:

a first collecting pipe comprising a first upper main board and a first lower main board, the first upper main board and the first lower main board being hermetically connected, a first channel and a second channel being formed between the first upper main board and the first lower main board;

a second collecting pipe provided with a third channel and a fourth channel; and a plurality of flat tubes in two rows, one ends of the flat tubes being communicated with the first channel and the second channel, respectively; and the other ends of the flat tubes being communicated with the third channel and the fourth channel, respectively; wherein the third channel is communicated with the first channel through a row of the flat tubes, and the fourth channel is communicated with the second channel through another row of the flat tubes; and wherein the first collecting pipe or the second collecting pipe is provided with an inlet and an outlet, the first upper main board is provided with a third middle rib and a plurality of second partitions, the first upper main board encloses with the first lower main board through the third middle rib to form the first channel and the second channel, and the first channel and the second channel are communicated with the second collecting pipe through the flat tubes, respectively;

the second partitions separate each of the first channel and the second channel into two chambers;

the first upper main board is further provided with two first reinforcing ribs, the two first reinforcing ribs are both arranged along a length direction of the first upper main board to separate the first channel and the second channel along the length direction, respectively; the two first reinforcing ribs are located in the first channel and the second channel, respectively; and the two first reinforcing ribs are parallel to the third middle rib.

11. The heat exchanger according to claim 10, wherein the first collecting pipe further comprises a second middle main board; the first upper main board encloses with the second intermediate main board through the third intermediate rib, and further encloses with the first lower main board to form the first channel and the second channel, and the first channel and the second channel are partially connected through the second intermediate main board.

12. The heat exchanger according to claim 11, wherein the second intermediate main board is provided with two rows of second slots and one row of third slots; the two rows of second slots are located on one side of the second partitions, and the one row of third slots are located on the other side of the second partitions; the first channel and the second channel are separated by the first reinforcing ribs into two parts which are communicated with each other via the second slots and the third slots.

13. The heat exchanger according to claim 10, wherein the first reinforcing rib is provided with a first through hole or a second through slot, and the first channel and the second channel are separated by the first reinforcing ribs into two parts which are communicated with each other via the first through hole or the second through slot;

one end of the third middle rib is provided with a second through hole or a third through slot, and the first channel and the second channel are communicated with each other via the second through hole or the third through slot.

14. The heat exchanger according to claim 1, wherein the first lower main board is of a U-shaped configuration, the first lower main board is provided with two rows of second flat tube slots, and the one ends of the flat tubes are sealed through walls which define the second flat tube slots.

15. The heat exchanger according to claim 12, wherein the second collecting pipe comprises a second lower main board and a second upper main board, the second lower main board is provided with a fourth middle rib, the second lower main board encloses with the second upper main board through the fourth middle rib to form the third channel and the fourth channel.

16. The heat exchanger according to claim 15, wherein the second collecting pipe further comprises a third intermediate main board which is provided with two rows of fourth slots, the second lower main board encloses with the third intermediate main board through the fourth middle rib, and further encloses with the second upper main board to form the third channel and the fourth channel.

17. The heat exchanger according to claim 16, wherein the second lower main board is provided with a plurality of third partitions which separate each of the third channel and the fourth channel into two chambers, an inlet and an outlet are respectively communicated with the chambers which are located at the same end of the third channel and the fourth channel, the third partitions are located adjacent to the inlet, and the second partitions are located on a side of the third partitions away from the inlet.

18. The heat exchanger according to claim 15, wherein the second lower main board is further provided with a plurality of flow equalizing plates which are disposed in the third channel and the fourth channel, the flow equalizing plates are provided with a plurality of flow equalizing holes, and areas of the flow equalizing holes of the plurality of flow equalizing plates in the third channel and the fourth channel are sequentially decreased along a refrigerant fluid flow direction.

19. The heat exchanger according to claim 13, wherein the two parts of each of the first channel and the second channel are communicated with each other via the second through slot, and an end surface of the first reinforcing rib is spaced apart from the first lower main board so as to form the second through slot; and the first channel and the second channel are communicated with each other via the third through slot, and an end surface of the third middle rib is spaced apart from the first lower main board so as to form the third through slot.

20. The heat exchanger according to claim 1, wherein each of the first upper main board and the first lower main board is of a flat-plate configuration.

* * * * *